United States Patent [19]

Sasaki et al.

[11] Patent Number: 4,849,325

[45] Date of Patent: Jul. 18, 1989

[54] LIGHT-SENSITIVE MATERIAL PACKAGE UNIT HAVING EXPOSURE FUNCTION

[75] Inventors: Noboru Sasaki; Keisuke Shiba, both of Kanagawa, Japan

[73] Assignee: Fuji Photo Film Co., Ltd., Kanagawa, Japan

[21] Appl. No.: 68,098

[22] Filed: Jun. 30, 1987

[30] Foreign Application Priority Data

Jun. 30, 1986 [JP] Japan ..... 61-153482

[51] Int. Cl.[4] ..... G03C 1/46; G03C 1/08; G03C 7/26; G03C 7/32

[52] U.S. Cl. ..... 430/505; 354/126; 430/506; 430/509; 430/542; 430/544; 430/552; 430/553; 430/554; 430/555; 430/556; 430/557; 430/558; 430/566; 430/567; 430/956; 430/957; 430/958

[58] Field of Search ..... 430/505, 506, 509, 544, 430/957, 542; 354/126

[56] References Cited

U.S. PATENT DOCUMENTS

| | | | |
|---|---|---|---|
| 4,409,323 | 10/1983 | Sato et al. | 430/549 |
| 4,434,225 | 2/1984 | Sugita et al. | 430/544 |
| 4,500,633 | 2/1985 | Menjo et al. | 430/957 |
| 4,564,587 | 1/1986 | Watanabe et al. | 430/957 |

FOREIGN PATENT DOCUMENTS 2010818 7/1979 United Kingdom .

*Primary Examiner*—Mukund J. Shah

*Attorney, Agent, or Firm*—Sughrue, Mion, Zinn, Macpeak, and Seas

[57] ABSTRACT

A light-sensitive material package unit having an exposure function is disclosed, in which said light-sensitive material comprises a support having provided thereon at least one red-sensitive silver halide emulsion layer containing at least one cyan coupler, at least one green-sensitive silver halide emulsion layer containing a magenta coupler, and at least one blue-sensitive silver halide emulsion layer containing a yellow coupler; at least one of said light-sensitive emulsion layers is composed of at least two layers being substantially the same in color sensitivity and different in sensitivity; and said light-sensitive emulsion layer composed of at least two layers contains a compound represented by formula (I)

$$A\text{-}(L_1)_b\text{-}Z_1 \qquad (I)$$

wherein A represents a component capable of releasing $-(L_1)_b-Z_1$ upon reacting with an oxidation product of a color developing agent; $L_1$ represents a timing group; $Z_1$ represents a residual group having active development inhibitory property; and b represents 0 or 1. The package unit exhibits improved exposure latitude and improved image sharpness.

13 Claims, 1 Drawing Sheet

LIGHT-SENSITIVE MATERIAL PACKAGE UNIT HAVING EXPOSURE FUNCTION

FIELD OF THE INVENTION

This invention relates to a light-sensitive material package unit having an exposure function, and more particularly, to a light-sensitive material package unit in which an element which exercises self-compensating functions on exposure latitude and interimage effect in combination with a simplified exposure function is incorporated into a light-sensitive material loaded in the package unit so as to provide a print having an improved qualities.

BACKGROUND OF THE INVENTION

A light-sensitive material package unit is known, with which one can take a photograph of a view through a finder simply by removing the outer package and pressing a shutter, and have the exposed film developed and printed simply by handing over the unit as it contains the film to a photofinishing laboratory. Such a package unit has been sold by Eastman Kodak under the name of "box camera". Its sale was, however, suspended because of inferior photographic quality and unhandiness.

In order to overcome such problems, the present inventors have previously made several inventions, as described, e.g., in Japanese Utility Model Application Nos. 75091/86 and 75794/86.

In the package units proposed by the present inventors, a photographic film is wound on a pair of reels shielded from light, with the area to be exposed to light being exposed. A package containing the film has such a structure that an image may be formed on the exposed area of the film through an optical lens system upon pressing a shutter plate fixed to a case. The light-sensitive material is protected from the outer atmosphere by the case and the outer package similarly to the conventional package units. Aiming at handiness and promptness for catching a shutter chance, this package unit employs a fixed focus system as an optical lens system, and, therefore, the exposure time is accordingly limited.

Additionally, since these light-sensitive material package units generally lack exposure latitude, one has to make a choice between those for outdoor use and those for indoor use. In addition, color images of high quality can hardly be obtained by such indoor photography.

Therefore, it has been desired to eliminate the above-described disadvantages by improving the light-sensitive material per se to be incorporated in the package unit. This is, the light-sensitive material to be used in the package unit is required firstly to have an improved exposure latitude, and secondarily to have improved image quality, such as sharpness, perspective, and texture even when exposed through a fixed focus system.

It is also possible to add a photochromic function hereinafter described to the exposure function of the unit. In such a case, also, the light-sensitive material to be used is required to fulfill the above requirements.

SUMMARY OF THE INVENTION

Accordingly, one object of this invention is to provide a light-sensitive material package unit which overcomes the disadvantages associated with exposure hardware by improving the exposure latitude of the incorporated light-sensitive material so as to have a smooth gradation from the highlights to the shadows, and by increasing sharpness of an image area in focus while reducing sharpness of an image area out of focus, to thereby achieve perspective and texture of the image as a whole. Other objects of this invention will be apparent from the description hereinafter given.

As a result of extensive investigations, it has now been found that the above object can be accomplished by a light-sensitive material package unit having an exposure function in which said light-sensitive material comprises a support having provided thereon at least one red-sensitive silver halid emulsion layer containing at least one cyan coupler, at least one green-sensitive silver halide emulsion layer containing a magenta coupler, and at least one blue-sensitve silver halid emulsion layer containing a yellow coupler; at least one of said light-sensitive emulsion layers is composed of at least two layers being substantially the same in color sensitivity and different in sensitivity; and said light-sensitive emulsion layer composed of at least two layers contains a compound represented by formula (I)

$$A—(L_1)_b—Z_1 \qquad (I)$$

wherein A represents a component capable of releasing $—(L_1)_b—Z_1$ upon reacting with an oxidation product of a color developing agent; $L_1$ represents a timing group; $Z_1$ represents a residual group having active development inhibitory property; and b represents 0 or 1.

BRIEF DESCRIPTION OF ACCOMPANYING DRAWINGS

DETAILED DESCRIPTION OF THE INVENTION

Figure 1:
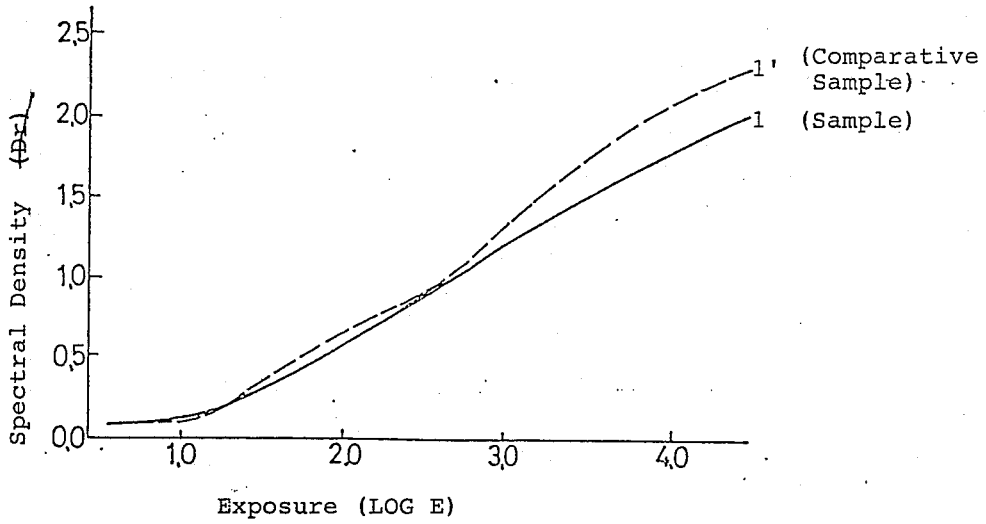
FIG. 1 is a graph showing characteristic curves of the sample according to the present invention and the comparative sample prepared in Example 1.

The light-sensitive material package unit having an exposure function according to the present invention can comprise a light-sensitive material contained in a cartridge, said cartridge being loaded in a case having an exposure function, e.g., a lens and a shutter, said case being packed in a box as described in Japanese Utility Model Application No. 75794/86. The outer box is packaged with packaging paper, etc., before use. Light-sensitive materials to be used in the package units according to the present invention include not only so-called 110 size films for pocket instamatic cameras, but also 126 size films, 35 mm films, etc.

The optical system conventionally employed comprises a lens having an F number of 8 or more in a fixed focus system, and, in most cases, a shutter mechanism having a fixed shutter speed, and the film is set at the fixed focal plane. In one embodiment of the present invention, the optical system (exposure function) can be improved by replacing the spherical lens used in the conventional optical system with an aspherical lens, to thereby achieve an improvement on image sharpness.

In another embodiment of the optical system according to the present invention, a photochromic function or an electrochromic function, and preferably a photochromic filter or a photochromic glass filter, can be provided in front of a lens (or in front of a shutter) in such a manner that would not become a bar to outer packaging.

Photochromism generally refers to a phenomenon by which hue and density reversibly change by the action of light. The term photochromism as used herein also refers to the phenomenon by which density in a visible region reversibly changes according to an outdoor light intensity. For example, the photochromic filter is such a filter that has a reversibly increasing optical density as the intensity of light outside of the package unit becomes high as described, e.g., in Noritada Tomoda, *Kagaku,* Vol. 24, No. 6, 61–68, "Photochromism and application", Kagaku Dojin (Jun., 1969). Japanese Patent application (OPI) No. 175039/85 (the term "OPI" as used herein means an "unexamined published Japanese Patent Application") describes that a photochromic glass plate can be provided just in front of a focal plane in order to improve bluing of an electronic camera using a CCD (charge-coupled device) or MOS (metal-oxide-semiconductor). Further, Japanese Patent Application (OPI) No. 97429/76 describes a substantially single-lens reflex camera having a function of exposure control through photometry at the photoreceptor wherein a photochromic glass plate is placed in the middle between a lens and a prism having a half-mirror. These disclosures are all concerned with cameras having an exposure controlling function by themselves.

In the present invention, satisfactory prints cannot be obtained merely by using photochromic optics. In other words, excellent color images cannot be obtained until such a photochromic function is combined with the above-described specific light-sensitive material.

Any photochromic element whose spectral density uniformly increases, preferably in the visible region of from 400 nm to 700 nm, can be used in the present invention. Such a photochromic element preferably includes a photochromic glass filter comprising glass having dispersed therein microfine crystals of a metal halide, e.g., silver iodide, copper bromide, cobalt bromide, etc., a specific element, e.g., cerium, europium, etc., either alone or in combination thereof. In most cases, the visible light density is increased according to ultra violet light intensity. The photochromic glass filter to be used preferably in the present invention usually has a transmittance of about 100% indoors and about 10% outdoors.

The light-sensitive material which can be used in the present invention comprises a film support having provided thereon a light-sensitive layer containing a red-sensitive silver halide and a cyan coupler (hereinafter referred to as RL), a light-sensitive layer containing a green-sensitive silver halide and a magneta coupler (hereinafter referred to as GL), and a light-sensitive layer containing a blue-sensitive silver halide and a yellow coupler (hereinafter referred to as BL). The light-sensitive material may further comprise an antihalation layer (hereinafter referred to as AHL), a yellow filter layer (hereinafter referred to as YFL), a protective layer (hereinafter referred to as PC), an intermediate layer (hereinafter referred to as ML), and the like. Any one of the light-sensitive layers should be composed of at least two layers. For example, GL is divided into a high-sensitivity green-sensitive layer (GL-O) and a low-sensitivity green-sensitive layer (GL-U), etc. In this case, the compound represented by formula (I) is preferably incorporated into the high-sensitivity layer. Further, when using tabular silver halide grains in GL-O and monodisperse fine silver halide grains in GL-U, the perspective of GL can be improved to obtain a broadened gradation from shadows to highlights.

It is possible that each of RL, GL, and BL is divided into a high-sensitivity layer and a low-sensitivity layer; the high-sensitivity layer being provided farther from the support than the low-sensitivity layer having the same color sensitivity. In this case, also, the compound of formula (I) is preferably added to the high-sensitivity layer of each emulsion layer.

It is preferably that the light-sensitive material to be used in the present invention exhibits sensitivity high enough to provide an excellent image even when exposed to indoor light, i.e., ISO sensitivity of 100 or more, preferably 150 or more, and more preferably from 150 to 1600.

When a photochromic function is employed, (1) a non-timing DIR (development inhibitor releasing) coupler which broadens an exposure latitude of each of BL, GL, and RL in self-compensation, (2) a timing DIR coupler which improves a color balance of BL, GL, and RL in self-compensation or (3) a combination of these two types of DIR couplers can be used. For instance, a non-timing DIR coupler is added to BL, GL, or RL in an amount of from about 10% to 100% by weight of a color coupler used therein, and, when a spectral color density of a photochromic glass filter is low particularly in the red region, a timing DIR coupler is added to a high-sensitivity layer of RL, or both the non-timing DIR coupler and the timing DIR coupler are added to the highest-sensitivity layer of RL so that development of RL is uniformly inhibited with respect to color development of BL or GL. In an attempt of broadening an exposure latitude, a DIR layer mainly comprising silver halide having light sensitivity equal to that of the highest-sesitivity layer of RL and a timing DIR coupler can be provided. Based on the concept set forth above, use of various DIR couplers can be selected depending on specifications of package units.

The utilization of the aforesaid photochromism function is no more than one embodiment of the present invention. It is a matter of course that the package unit of the present invention is effective in cases where such a photochromic function is not adopted.

The greatest feature of the present invention lies in use of the compound represented by formula (I). The compound of formula (I) will be described in detail.

In formula (I), the component as represented by A preferably includes a color coupler residue as well as a coupler residue which does not form a dye when released upon coupling with an oxidation product of a developing agent. Examples of usable coupler residues are described, e.g., in U.S. Pat. Nos. 3,632,345 and 3,958,993, Japanese Patent application (OPI) Nos. 64927/76, 161237/77, etc.

Examples of yellow coupler residues are those derived from pivaloylacetanilide coupler, benzoylacetanilide couplers, malonic diester couplers, malonic acid diamine couplers, dibenzoylmethane couplers, benzothiazole acetamide couplers, malonic ester monoamide couplers, benzothiazolyl acetate couplers, benzoxazolyl acetamide couplers, benzoxazolyl acetate couplers, benzimidazolyl acetamide couplers and benzimidazolyl acetate couplers; heterocyclic ring-substituted acetamide couplers or heterocyclic ring-substituted acetate couplers disclosed in U.S. Pat. No. 3,841,880; acylacetamide couplers disclosed in U.S. Pat. No. 3,770,446, British Pat. No. 1,459,171, West German Patent Application (OLS) No. 2,503,099, Japanese Patent Application (OPI) No. 139738/75 and *Research Disclosure,* No.

15737 (May 1977); and heterocyclic ring-substituted couplers disclosed in U.S. Pat. No. 4,046,574.

Examples of magenta coupler residues represented by A preferably include those derived from 5-oxo-2-pyrazoline couplers, pyrazolo-[1,5-a]benzimidazole couplers, cyanoacetophenone couplers and pyrazolotriazole couplers.

Examples of cyan coupler residues represented by A preferably include those derived from phenol couplers and α-naphthol couplers.

Examples of the aforesaid coupler residue releasable upon coupling with an oxidation product of a developing agent without forming a dye are described in U.S. Pat. Nos. 4,052,213, 4,089,491, 3,632,345, 3,958,993, and 3,961,959.

The development inhibitor residue as represented by $Z_1$ includes a divalent nitrogen-containing heterocyclic group or nitrogen-containing heterocyclic thio group as a basic structure (hereinafter referred to as Z) to which a substituent of formula $-(L_2-Y)_c$ may be introduced. Specific examples of the heterocyclic thio group include a tetrazolylthio group, a benzothiazolylthio group, benzimidazolylthio group, a triazolylthio group, an imidazolylthio group, etc. In cases where $-(L_2-Y)_c$ is introduced to Z, the compound of the present invention is represented by the formula (II)

$$A-[(L_1)_b-Z-(L_2-Y)_c]_p \quad \text{(II)}$$

wherein A, $L_1$, and b are defined above, Z represents a basic structure of a development inhibitor bonded to the coupling position of the coupler residue A either directly (when b=0) or via a linking group $L_1$ (when b=1); Y represents a substituent bonded to Z via a linking group $L_2$, which functions to manifestate the development inhibitory activity of Z; $L_2$ represents a linking group containing a chemical bond capable of being cut off in a developer; c represents 1 or 2; when c is 2, $-L_2-Y$ may be the same or different; an p represents 1 or 2.

The compound represented by formula (II) releases $-\ominus Z-(L_2-Y)_c$ or $-\ominus L_1-Z-(L_2-Y)_c$ upon coupling with an oxidation product of a color developing agent. $L_1$ in $-\ominus L_1-Z-(L_2-Y)_c$ is immediately released therefrom to produce $-\ominus Z-(L_2-Y)_c$. $-\ominus Z-(L_2-Y)_c$ is then diffused through a light-sensitive layer while exercising development inhibition, with a part of which flowing into a color developing solution. The $-\ominus Z-(L_2-Y)_c$ dissolved in the developing solution rapidly decomposes at the chemical bond contained in $L_2$. That is, the linkage between Z and Y is cleaved, thereby leaving a compound composed of Z having small development inhibitory activity to which a water-soluble group is attached in the developing solution. Thus, the development inhibitory activity substantially disappears.

As a result, any compound having development inhibitory activity is not accumulated in the developing solution, thus making it possible not only to repeatedly reuse the developing solution, but also to incorporate a sufficient amount of a DIR coupler in the light-sensitive material.

Specific examples of the compounds of formula (I) and (II) are illustrated below. In the formulae shown, replacement of the $-L_2-Y-$moiety with a hydrogen atom gives the corresponding compounds of formula (I).

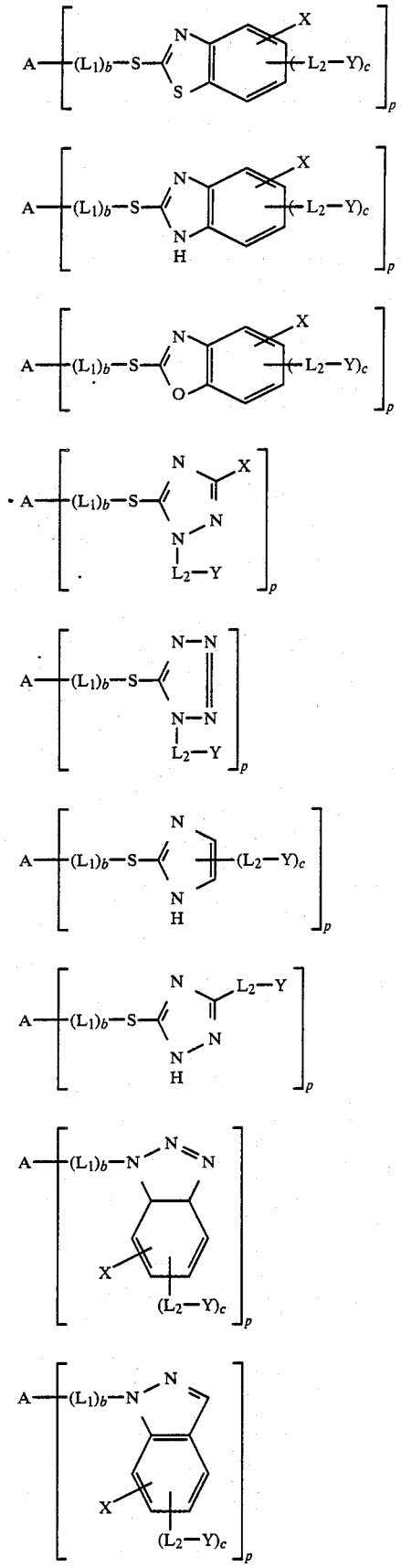

-continued

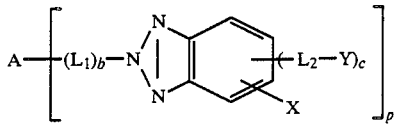

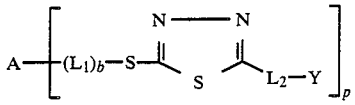

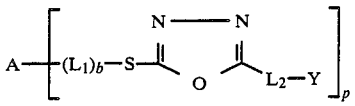

In the above-illustrated formulae, X represents a hydrogen atom, a halolgen atom, an alkyl group, an alkenyl group, an alkanamido group, an alkenamido group, an alkoxy group, a sulfonamido group or an aryl group. The substituent represented by X is to be contained in the moiety of Z in formula (II).

Y in formula (II) specifically includes an alkyl group, a cycloalkyl group, an alkenyl group, a cycloalkenyl group, an aryl group, an aralkyl group, or a cyclic group.

Examples of the linking group as represented by $L_1$ in formula (II) are shown below as combined with A and $Z—(L_2—Y)_c$ (replacement of $—L_2—Y$ with hydrogen gives formula (I)). The reference given in parentheses is for the linking group.

$A\text{+}OCH_2—Z—(L_2—Y)_c\text{]}_p$
(U.S. Pat. No. 4,146,396)

$A\text{+}SCH_2—Z—(L_2—Y)_c\text{]}_p$ $A\text{+}O\overset{O}{\overset{\|}{C}}—Z—(L_2—Y)_c\text{]}_p$
(West German Patent Publication No. 2,626,315)

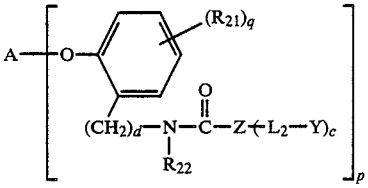

(West German Patent Publication No. 2,855,697; wherein d is 0, 1, or 2)

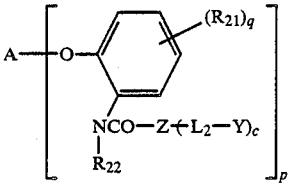

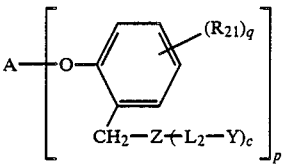

-continued

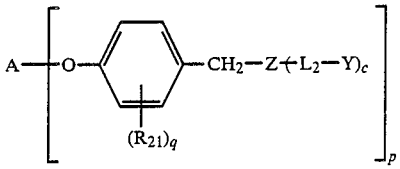

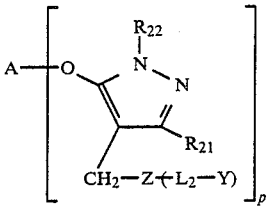

wherein A, z, $L_2$, Y, c and p are as defined above; $R_{21}$ represents a hydrogen atom, a halogen atom, an alkyl group, an alkenyl group, an aralkyl group, an alkoxy group, an alkoxycarbonyl group, an anilino group, an acylamino group, a ureido group, a cyano group, a nitro group, a sulfonamido group, a sulfamoyl group, a carbamoyl group, an aryl group, a carboxyl group, a sulfo group, a cycloalkyl group, an alkanesulfonyl group, an arylsulfonyl group, or an acyl group; $R_{22}$ represents a hydrogen atom, an alkyl group, an alkenyl group, an aralkyl group, a cycloalkyl group, or an aryl group; and q represents 1 to 4; when q is 2, the $R_{21}$ groups together may form a condensed ring.

In these DIR couplers of formula (II) where b=1, the releasable group which is released upon reaction with an oxidation product of a developing agent rapidly decomposes to thereby release a development inhibitor $[H—Z—(L_2—Y)_c]$. Therefore, the DIR couplers wherein b=1 produce the same effects as produced by the DIR couplers having no linking group $L_1$ (the compounds of formula (II) wherein b=0).

The aforesaid chemical bond contained in the linking group $L_2$ is cleaved by the action of a nucleophilic reagent present in a developing solution, such as a hydroxyl ion, hydroxylamine, etc.

The divalent linking group $L_2$ is bonded to Z at one end thereof either directly or via an alkylene group and/or a phenylene group and to Y at the other end thereof. In cases where the linking group is linked to Z via an alkylene group and/or a phenylene group, such an intermediate divalent group may contain an ether linkage, an amido linkage, a carbonyl group, a thioether linkage, a sulfo group, a sulfonamido linkage or a urea linkage.

Preferred examples of the linking group $L_2$ are shown below as combined with Z and Y.

$—Z—(CH_2)_e—COO—Y$ $—Z—(CH_2)_e—O\overset{O}{\overset{\|}{C}}—Y$

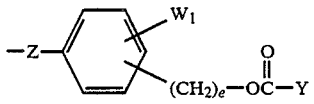

-continued

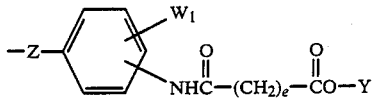

$-Z-(CH_2)_e-NHCOO-Y$ $-Z-(CH_2)_e-OC(=O)NH-Y$ $-Z-NHC(=O)-(CH_2)_e-C(=O)-Y$

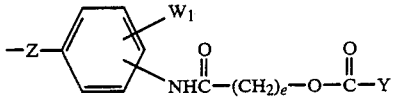

$-Z\leftarrow CH_2)_f-COOCH_2CH_2SO_2-Y$

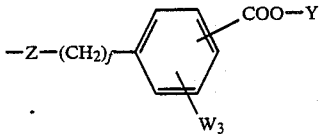

$-Z-NCOO-Y$ ($W_2$)

$-Z-N-COCO-Y$ ($W_2$)

wherein $W_1$ represents a hydrogen atom, a halogen atom, an alkyl group having from 1 to 10 carbon atoms, and preferably from 1 to 5 carbon atoms, an alkanamido group having from 1 to 10 carbon atoms, and preferably from 1 to 5 carbon atoms, an alkoxy group having from 1 to 10 carbon atoms, and preferably from 1 to 5 carbon atoms, an alkoxycarbonyl group having from 1 to 10 carbon atoms, and preferably from 1 to 5 carbon atoms, an aryloxycarbonyl group, an alkanesulfonamido group having from 1 to 10 carbon atoms, and preferably from 1 to 5 carbon atoms, an aryl group, a carbamoyl group, an N-alkylcarbamoyl group having from 1 to 10 carbon atoms, and preferably from 1 to 5 carbon atoms, a nitro group, a cyano group, an arylsulfonamide group, a sulfamoyl group, an imido group, etc.; $W_2$ represents a hydrogen atom, an alkyl group having from 1 to 6 carbon atoms, an aryl group having from 6 to 12 carbon atoms or an alkenyl group having from 1 to 6 carbon atoms; $W_3$ represents a hydrogen atoms, a halogen atoms, a nitro group, an alkoxy group having from 1 to 6 carbon atoms or an alkyl group having from 1 to 6 carbon atoms; e represents 0 or an integer of from 1 to 10, and preferably 0 or an integer of from 1 to 5; and f represents 0 or an integer of from 1 to 6.

The alkyl or alkenyl group as represented by X or Y includes substituted or unsubstituted straight or branched chain or cyclic alkyl or alkenyl groups having from 1 to 10 carbon atoms, and preferably from 1 to 5 carbon atoms, with those having substituents being preferred. The substituents for the alkyl or alkenyl group include a halogen atom, a nitro group, an alkoxy group having from 1 to 4 carbon atoms, an aryloxy group having from 6 to 10 carbon atoms, an alkanesulfonyl group having from 1 to 4 carbon atoms, an arylsulfonyl group having from 6 to 10 carbon atoms, an alkanamido group having from 1 to 5 carbon atoms, an anilino group, a benzamido group, an alkylcarbamoyl group having from 1 to 6 carbon atoms, a carbamoyl group, an arylcarbamoyl group having from 6 to 10 carbon atoms, an alkylsulfonamido group having from 1 to 4 carbon atoms, an arylsulfonamido group having from 6 to 10 carbon atoms, an alkylthio group having from 1 to 4 carbon atoms, an arylthio group having from 6 to 10 carbon atoms, a phthalimido group, a succinimido group, an imidazolyl group, a 1,2,4-triazolyl group, a pyrazolyl group, a benzotriazolyl group, a furyl group, a benzothiazolyl group, an alkylamino group having from 1 to 4 carbon atoms, an alkanoyl group having from 1 to 4 carbon atoms, a benzoyl group, an alkanoyloxy group having from 1 to 4 carbon atoms, a benzoyloxy group, a perfluoroalkyl group having from 1 to 4 carbon atoms, a cyano group, a tetrazolyl group, a hydroxyl group, a carboxyl group, a mercapto group, a sulfo group, an amino group, an alkylsulfamoyl group having from 1 to 4 carbon atoms, a aryl carbonyl group group having from 6 to 10 carbon atoms, an aryloxycarbonyl group having from 6 to 10 carbon atoms, an imidazolidinyl group or an alkylidenamino group having from 1 to 6 carbon atoms.

The alkanamido group or alkenamido group as represented by X includes substituted or unsubstituted straight or branched chain or cyclic alkanamide or alkenamide groups having from 1 to 10 carbon atoms, and preferably from 1 to 5 carbon atoms. The substituents for the alkanamide or alkenamide group are selected from those enumerated for the alkyl or alkenyl group.

The alkoxy group as represented by X includes substituted or unsubstituted straight or branched chain or cyclic alkoxy groups having from 1 to 10 carbon atoms, and preferably from 1 to 5 carbon atoms. The substituents therefor are selected from those enumerated for the alkyl or alkenyl group.

The aryl group as represented by Y includes a substituted or unsubstituted phenyl or naphthyl group. The substituents therefor are selected from those enumerated above for the alkyl or alkenyl group and, in addition, an alkyl group having from 1 to 4 carbon atoms.

The heterocyclic group as represented by Y includes a diazolyl group (e.g., a 2-imidazolyl group, a 4-pyrazolyl group, etc.), a triazolyl group (e.g., a 2,2,4-triazol-3-yl group, etc.), a thiazolyl group (e.g., a 2-benzothiazolyl group, etc.), an oxazolyl group (e.g., a 1,3-oxazol-2-yl group, etc.), a pyrrolyl group, a pyridyl group, a diazonyl group (e.g., a 1,4-diazin-2-yl group, etc.), a triazinyl group (e.g., a 1,2,4-triazin-5-yl group, etc.), a furyl group, a diazolinyl group (e.g., an imidazolin-2-yl group, etc.), a pyrrolinyl group, a thienyl group, etc.

Of the couplers represented by formula (II), those represented by formulae (III) to (IX) shown below are particularly useful because of their strong development inhibitory activity exhibited after release.

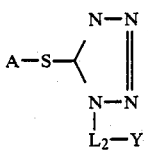

(III)

-continued (IV)

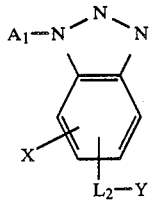

(V)

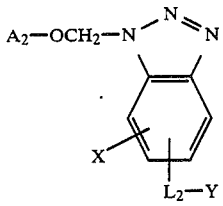

(VI)

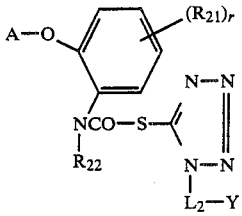

(VII)

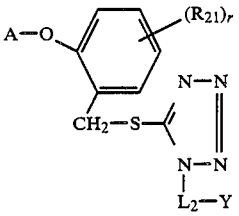

(VIII)

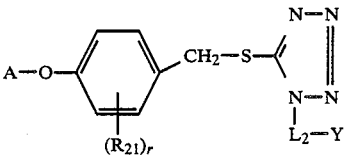

(IX)

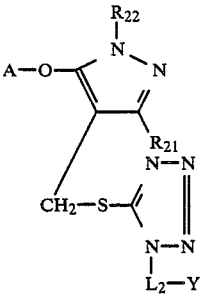

wherein a, $L_2$, X, Y, and $R_{21}$ are as defined above; r represents 1 to 4; when r is 2, $R_{21}$ may form a condensed ring; $A_1$ has the same meaning as A in formula (II) excluding cyan coupler residual groups; and $A_2$ represents a cyan coupler residual group as recited for A in formula (II).

Among the couplers of formulae (III) to (IX), the more preferred couplers are compounds represented by formulae (X) to (XXI) shown below. These couplers represented by formulae (X) to (XXI) are particularly effective because of their high coupling rate.

(X)

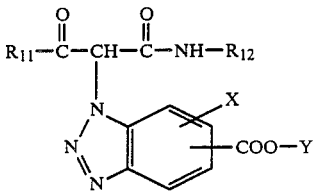

(XI)

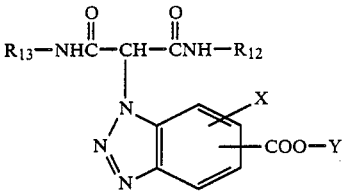

(XII)

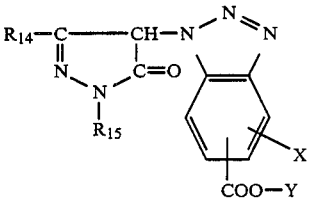

(XIII)

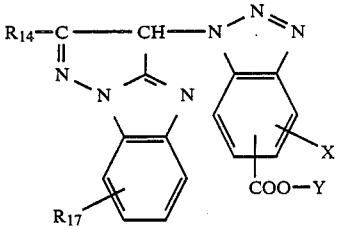

(XIV)

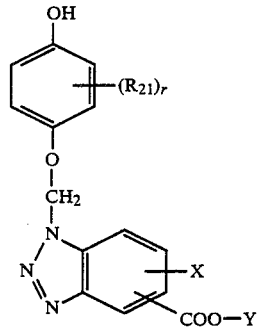

(XV)

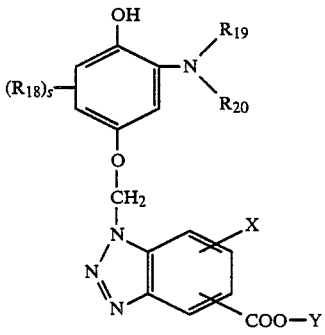

-continued (XVI)

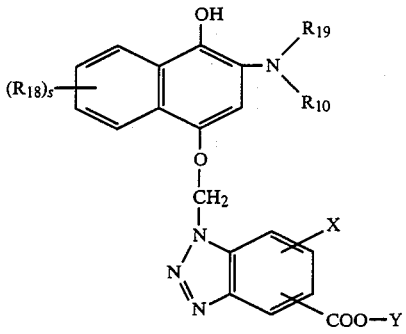

(XVII)

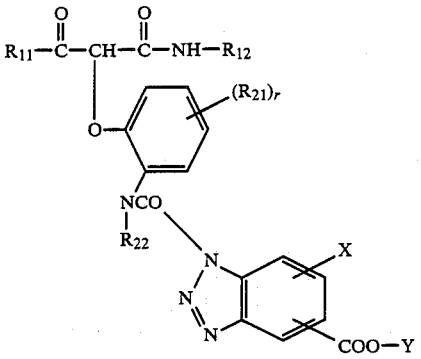

(XVIII)

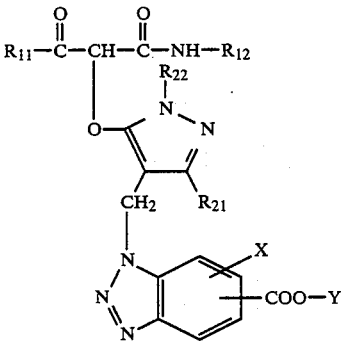

(XIX)

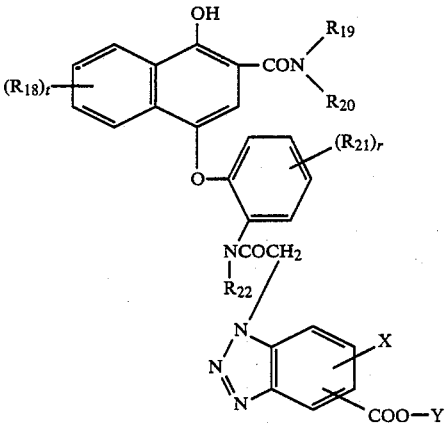

-continued (XX)

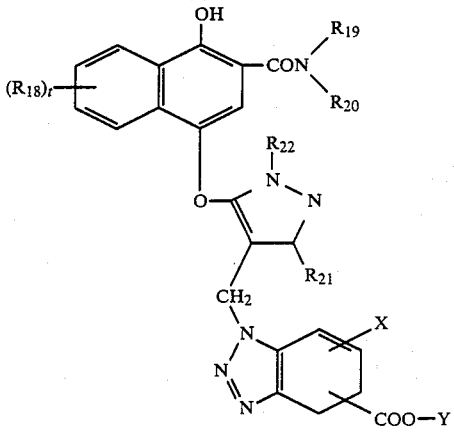

(XXI)

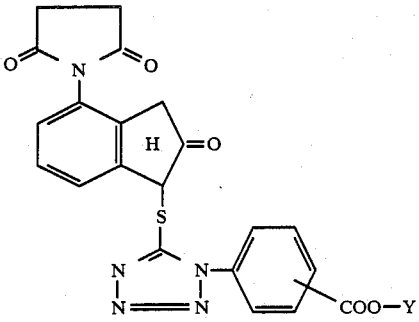

In formulae (X) to (XXI), X, Y, $R_{21}$, and r are as defined above.

In formulae (X), (XI), (XVII), and (XVIII), $R_{11}$ represents an aliphatic group, an aromatic group, an alkoxy group, or a heterocyclic group; and $R_{12}$ and $R_{13}$ each represents an aromatic group or a heterocyclic group.

The aliphatic group as represented by $R_{11}$ preferably includes a substituted or unsubstituted, chain or cyclic alkyl group having from 1 to 22 carbon toms. Preferred examples of the substituents for the alkyl group include a substituted or unsubstituted alkoxy group, a substituted or unsubstituted aryloxy group, a substituted or unsubstituted amino group, a substituted or unsubstituted acylamino group, a halogen atom, and the like. Specific examples of useful aliphatic group for $R_{11}$ are an isopropyl group, an isobutyl group, a t-butyl group, an isoamyl group, a t-amyl group, a 1,1-dimethylbutyl group, a 1,1-dimethylhexyl group, a 1,1-diethylhexyl group, a dodecyl group, a hexadecyl group, an octadecyl group, a cyclohexyl group, a 2-methoxyisopropyl group, a 2-phenoxyisopropyl group, a 2-p-t-butylphenoxyisopropyl group, an α-aminoisopropyl group, an α-(diethylamino)isopropyl group, an α-(succinimido)isopropyl group, an α-(phthalimido)isopropyl group, an α-(benzenesulfonamido)isopropyl group, etc.

The aromatic group (especially a phenyl group) as represented by $R_{11}$, $R_{12}$, or $R_{13}$ may be substituted. The substituents for the aromatic group, e.g., a phenyl group, include alkyl, alkenyl, alkoxy, alkoxycarbonyl, alkoxycarbonylamino, aliphatic amide, alkylsulfamoyl, alkylsulfonamide, alkylureido, and alkyl-substituted succinimido groups, having up to 32 carbon atoms (the alkyl group or alkyl moiety may contain in its chain an aromatic group); aryloxy, aryloxycarbonyl, arylcarbamoyl, arylamide, arylsulfamoyl, arylsulfonamide, and arylureido groups (the aryl moiety may further be substituted with one or more alkyl groups having from 1 to 22 carbon atoms in total); an amino group, an alkylamino group having from 1 to 6 carbon atoms, a hydroxyl group, a carboxyl group, a sulfo group, a nitro group, a cyano group, a thiocyano group, and a halogen atom.

The aromatic group as represented by $R_{11}$, $R_{12}$ or $R_{13}$ further includes a substituted or unsubstituted condensed ring, e.g., a naphthyl group, a quinolyl group, an isoquinolyl group, a chromanyl group, a coumaranyl group, a teterahydronaphthyl group, etc.

When $R_{11}$ represents an alkoxy group, the alkyl moiety thereof includes a substituted or unsubstituted, straight or branched chain or cyclic alkyl or alkenyl group having from 1 to 40 carbon atoms, and preferably from 1 to 22 carbon atoms. The substituents therefor include a halogen atom, an aryl group, an alkoxy group, etc.

When $R_{11}$, $R_{12}$, or $R_{13}$ represents a heterocyclic group, the heterocyclic ring is bonded to the carbon atom of the carbonyl group or the nitrogen atom of the amido group in the $\alpha$-acylacetamide moiety via one of the ring-constituting carbon atoms. Examples of such a heterocyclic ring are thiophene, furan, pyran, pyrrole, pyrazole, pyridine, pyrazine, pyrimidine, pyridazine, indolidine, imidazole, thiazole, oxazole, triazine, thiazine, oxazine, etc. These heterocyclic rings may have substituents on the ring.

In formula (XII), $R_{15}$ represents a substituted or unsubstituted, straight or branched chain or cyclic alkyl or alkenyl group having from 1 to 40 carbon atoms, and preferably from 1 to 22 carbon atoms, a substituted or unsubstituted aralkyl group having up to 40 carbon atoms, and preferably up to 22 carbon atoms, a substituted or unsubstituted aryl group (e.g., a phenyl group, an $\alpha$-or $\beta$-naphthyl group, etc.), a substituted or unsubstituted heterocyclic group, an aliphatic or aromatic acyl group, an alkylsulfonyl group, an arylsulfonyl group, an alkylcarbamoyl group, an arylcarbamoyl group, an alkylthiocarbamoyl group, or an arylthiocarbamoyl group.

Specific examples of the alkyl, alkenyl or aralkyl group are a methyl group, an isopropyl group, a t-butyl group, a hexyl group, a dodecyl group, an allyl group, a cyclopentyl group, a cyclohexyl group, a norbonyl group, a benzyl group, a $\beta$-phenylethyl group, a cyclopentenyl group, a cyclohexenyl group, etc. The substituents for the alkyl, alkenyl, or aralkyl group include a halogen atom, a nitro group, a cyano group, an aryl group, an alkoxy group, an aryloxy group, a carboxyl group, an alkylthiocarbonyl group, an arylthiocarbonyl group, an alkoxycarbonyl group, an aryloxycarbonyl group, a sulfo group, a sulfamoyl group, a carbamoyl group, an acylamino group, a diacylamino group, a ureido group, a urethane group, a thiourethane group, a sulfonamido group, a heterocyclic group, an arylsulfonyl group, an alkylsulfonyl group, an arylthio group, an alkylthio group, an alkylamino group, a dialkylamino group, an anilino group, an N-arylanilino group, an N-alkylanilino group, an N-acylanilino group, a hydroxyl group, a mercapto group, etc.

Substituents for the aryl group include an alkyl group, an alkenyl group, a cyclic alkyl group, an aralkyl group, a cyclic alkenyl group, a halogen atom, a nitro group, a cyano group, an aryl group, an alkoxy group, an aryloxy group, a carboxyl group, an alkoxycarbonyl group, an aryloxycarbonyl group, a sulfo group, a sulfamoyl group, a carbamoyl group, an acylamino group, a diacylamino group, a ureido group, a urethane group, a sulfonamido group, a heterocyclic group, an arylsulfonyl group, an alkylsulfonyl group, an arylthio group, an alkylthio group, an alkylamino group, a dialkylamino group, an anilino group, an N-alkylanilino group, an N-arylanilino group, an N-acylanilino group, a hydroxyl group, a mercapto group, etc.

The heterocyclic group as represented by $R_{15}$ includes a 5- or 6-membered heterocyclic or condensed heterocyclic group containing a nitrogen atom, an oxygen atom or a sulfur atom as a hetero atom, e.g., a pyridyl group, a quinolyl group, a furyl group, a benzothiazolyl group, an oxazolyl group, an imidazolyl group, a naphthoxazolyl group, etc. Substituents for these heterocyclic groups are selected from those enumerated for the aryl group.

$R_{15}$ preferably represents a phenyl group having at least one substituent, e.g., an alkyl group, an alkoxy group, a halogen atom, etc., at the ortho position(s). Of the couplers of formula (XII), those wherein $R_{15}$ is such a substituted phenyl group are less susceptible to discoloration due to light or heat as they remain in the films.

In formulae (XII) and (XIII), $R_{14}$ represents a hydrogen atom, a substituted or unsubstituted, straight or branched chain, or cyclic alkyl or alkenyl group having from 1 to 40, and preferably from 1 to 22, carbon atoms, a substituted or unsubstituted aralkyl group having up to 40, and preferably up to 22, carbon atoms (the substituent for the alkyl, alkenyl, or aralkyl group is selected from those recited for $R_{15}$), a substituted or unsubstituted aryl group (the substituent is selected from those recited for $R_{15}$), a substituted or unsubstituted heterocyclic group (the substituent is selected from those recited for $R_{15}$), an alkoxycarbonyl group (e.g., a methoxycarbonyl group, an ethoxycarbonyl group, a stearyloxycarbonyl group, etc.), an aralkyloxycarbonyl group (e.g., a benzyloxycarbonyl group, etc.), an alkoxy group (e.g., a methoxy group, an ethoxy group, a heptadecyloxy group, etc.), an aryloy group (e.g., a phenoxy group, a tolyloxy group, etc.), an alkylthio group (e.g., an ethylthio group, a dodecylthio group, etc.), an arylthio group (e.g., a phenylthio group, an $\alpha$-naphthylthio group, etc.), a carboxyl group, an acylamino group (e.g., an acetylamino group, a 3-[(2,4-di-t-amylphenoxy)acetamido]benzamide group, etc.), a diacylamino group, an N-alkylacylamino group (e.g., an N-methylpropionamide group, etc.), an N-arylacylamino group (e.g., an N-phenylacetamide group, etc.), a ureido group (e.g., a ureido group, an N-arylureido group, an N-alkylureido group, etc.), a urethane group, a thiourethane group, an arylamino group (e.g., a phenylamino group, an N-methylanilino group, a diphenylamino group, an N-acetylanilino group, a 2-chloro-5-tetradecanamidoanilino group, etc.), an alkylamino group (e.g., an n-butylamino group, a methylamino group, a cyclohexylamino group, etc.), a cycloamino group (e.g., a piperidino group, a pyrrolidino group, etc.), a heterocyclic amino group (e.g., a 4-pyridylamino group, a 2-benzoxazolylamino group, etc.), an alkylcarbonyl group (e.g., a methylcarbonyl group, etc.), an arylcarbonyl group (e.g., a phenylcarbonyl group, etc.), a sulfonamide group (e.g., an alkylsulfonamide group, an arylsulfonamide group, etc.), a carbamoyl group (e.g., an ethylcarbamoyl group, a dimethylcarbamoyl group, an N-methylphenylcarbamoyl group, an N-phenylcarbamoyl group, etc.), a sulfamoyl group (e.g., an N-arylalkylsulfamoyl group, an N,N-dialkylsufamoyl group, an N-arylsulfamoyl group, an N-alkyl-N-arylsulfamoyl group, an N,N-diarylsulfamoyl group, etc.), a cyano group, a hydroxyl group, a mercapto group, a halogen atom, or a sulfo group.

In formula (XIII), $R_{17}$ represents a hydrogen atom, a substituted or unsubstituted, straight or branched chain, or cyclic alkyl or alkenyl group having up to 32 carbon atoms, and preferably up to 22 carbon atoms, a substituted or unsubstituted aralkyl group having up to 22 carbon atoms (the substituent for the alkyl, alkenyl or aralkyl group is selected from those recited for $R_{15}$), a substituted or unsubstituted, aryl or heterocyclic group (the substituent is selected from those enumerated for $R_{15}$), a cyano group, an alkoxy group, an aryloxy group, a halogen atom, a carboxyl group, an alkoxycarbonyl group, an aryloxycarbonyl group, an acyloxy group, a sulfo group, a sulfamoyl group, a carbamoyl group, an acylamino group, a diacylamino group, a ureido group, a urethane group, a sulfonamide group, an arylsulfonyl group, an alkylsulfonyl group, an arylthio group, an alkylthio group, an alkylamino group, a dialkylamino group, an anilino group, an N-arylanilino group, an N-alkylanilino group, a hydroxyl group, or a mercapto group.

In formulae (XV), (XVI), (XIX), and (XX), $R_{18}$, $R_{19}$, and $R_{20}$ each represents a group employable in ordinary 4-equilvalent phenol or $\alpha$-naphthol couplers; r represents an integer of from 1 to 4; s represents an integer of from 1 to 3; and t represents an integer of from 1 to 5. More specifically, the group represented by $R_{18}$ includes a hydrogen atom, a halogen atom, a substituted or unsubstituted aliphatic hydrocarbon residue, an acylamino group, —O—$R_{31}$, or —S—$R_{31}$, wherein $R_{31}$ represents a substituted or unsubstituted aliphatic hydrocarbon residual group. When s or t is 2 or more, $R_{18}$ may be the same or different. The group represented by $R_{19}$ or $R_{20}$ includes a hydrogen atom, a substituted or unsubstituted aliphatic hydrocarbon residue, a substituted or unsubstituted aryl group or a substituted or unsubstituted heterocyclic group provided that at least one of $R_{19}$ and $R_{20}$ may be the group other than a hydrogen atom. $R_{19}$ and $R_{20}$ may be taken together to form a nitrogen-containing heterocyclic nucleus.

The aliphatic hydrocarbon residual group as represented by $R_{18}$, $R_{19}$, or $R_{20}$ may be saturated or unsaturated and may have a straight or branched or cyclic structure. The aliphatic hydrocarbon residual group preferably includes an alkyl group, e.g., methyl group, an ethyl group, a propyl group, an isopropyl group, a butyl group, a t-butyl group, an isobutyl group, a dodecyl group, an octadecyl group, a cyclobutyl group, a cyclohexyl group, etc.; and an alkenyl group, e.g., an allyl group, an octenyl group, etc.

The aryl group as represented by $R_{19}$ or $R_{20}$ includes a phenyl group, a naphthyl group, etc. The heterocyclic group typically includes a pyridinyl group, a quinolyl group, a thienyl group, a piperidyl group, an imidazolyl group, etc.

Substituents to be introduced into the aliphatic hydrocarbon residual group, aryl group, and heterocyclic group include a halogen atom, a nitro group, a hydroxyl group, a carboxyl group, an amino group, a substituted amino group, a sulfo group, an alkyl group, an alkenyl group, an aryl group, a heterocyclic group, an alkoxy group, an aryloxy group, an arylthio group, an arylthiazo group, an acylamino group, a carbamoyl group, an ester group, an acyl group, an acyloxy group, a sulfonamide group, a sulfamoyl group, a sulfonyl group, a morpholino group, etc.

In the above-illustrated formulae, any of the substituents $R_{11}$, $R_{12}$, $R_{13}$, $R_{14}$, $R_{15}$, $R_{17}$, $R_{18}$, $R_{19}$, and $R_{20}$ may be connected together, or any of them may be a divalent group to form a symmetric or unsymmetric complex coupler.

Specific but non-limiting examples of the couplers of formula (I) according to the present invention are shown below. In addition to these examples, the compounds described in Japanese Patent Application No. 113596/85 are also included in the scope of the present invention.

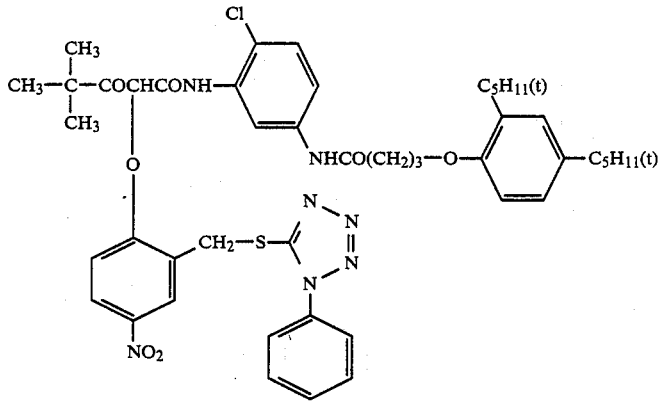

(1)

-continued
(2)
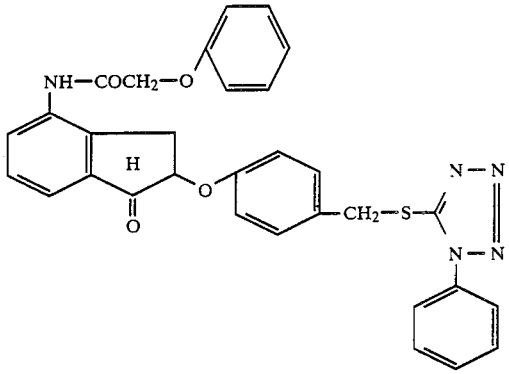
(3)
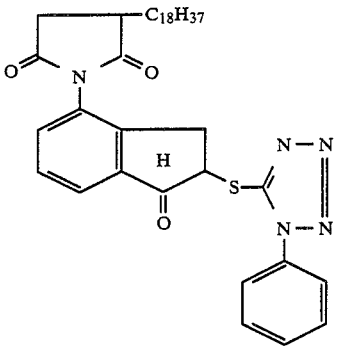
(4)
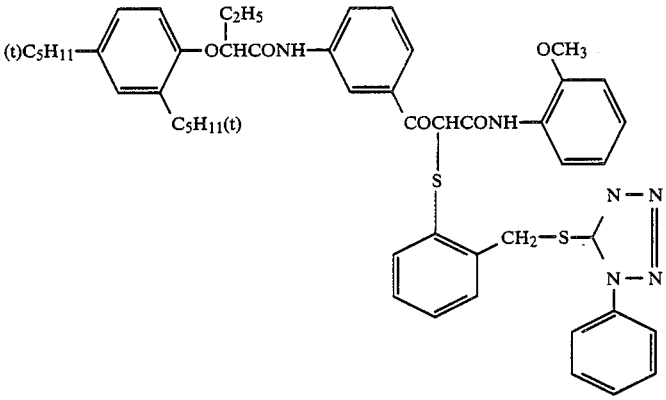
(5)
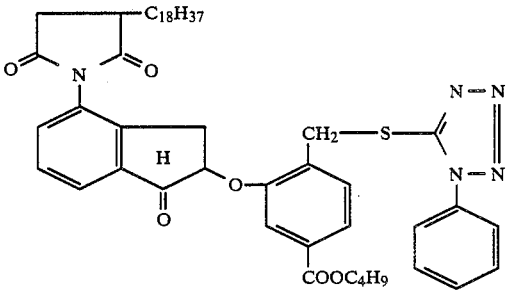

-continued
(6)
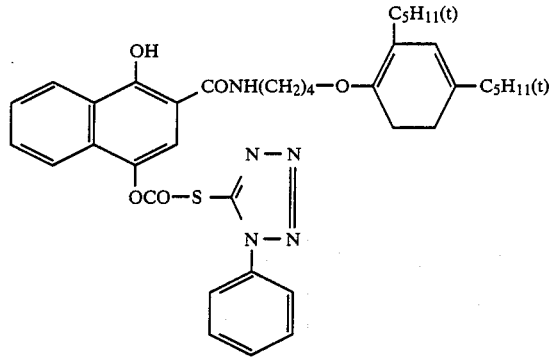
(7)
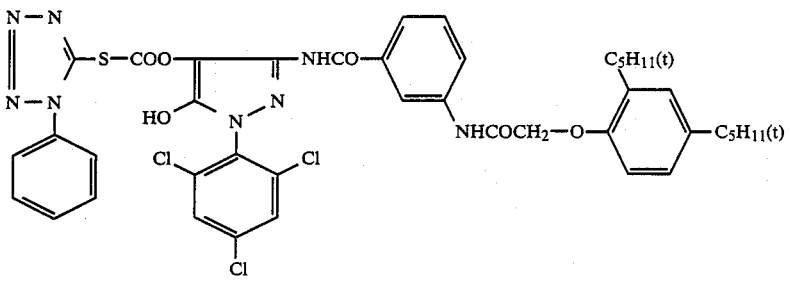
(8)
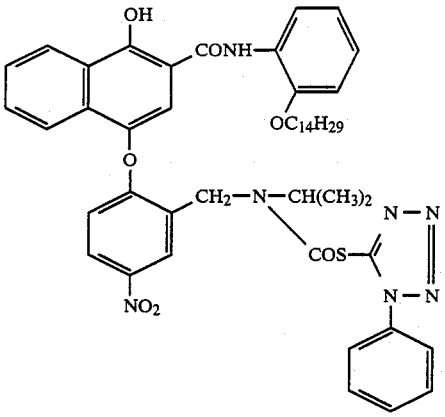
(9)
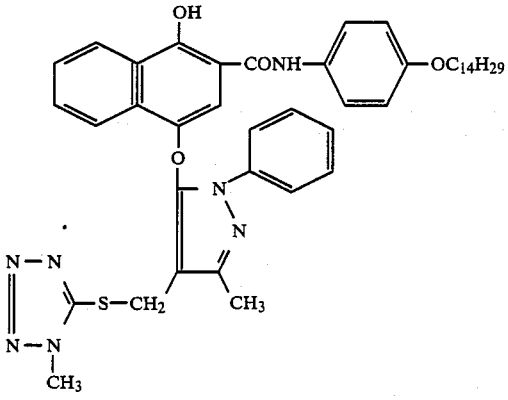

-continued
(10)
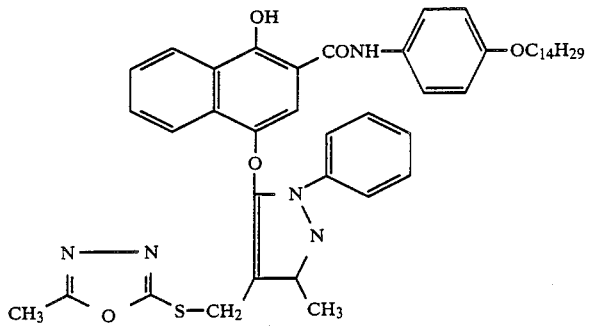
(11)
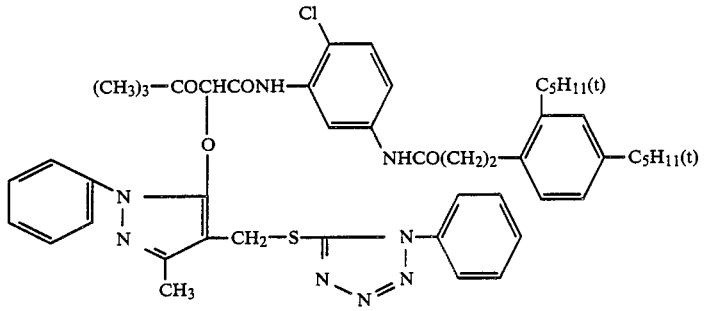
(12)
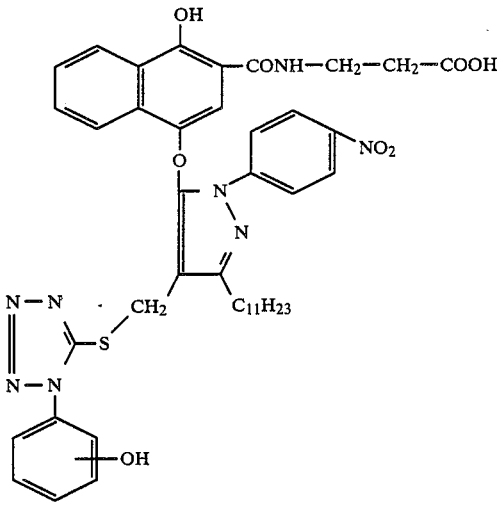
(13)
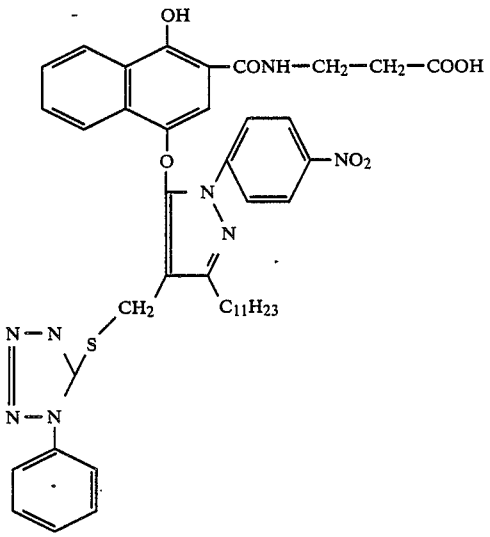

-continued
(14)
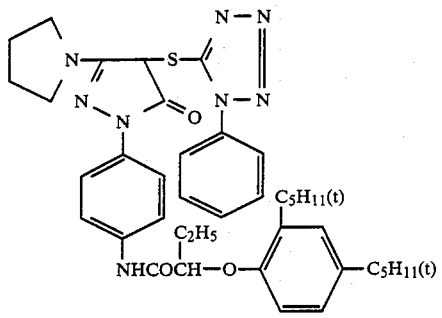
(15)
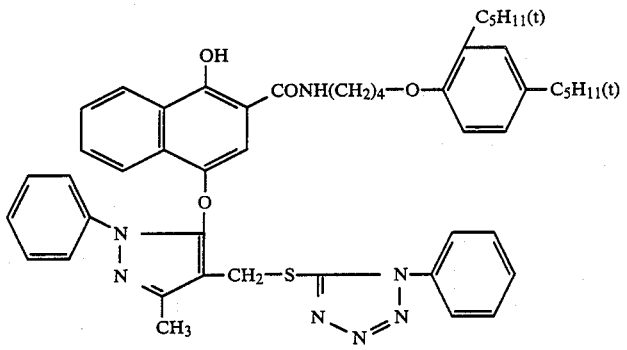
(16)
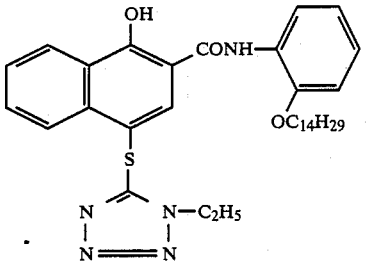
(17)
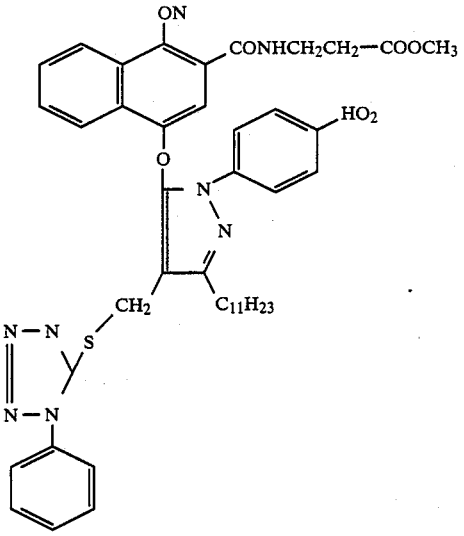

-continued
(18)
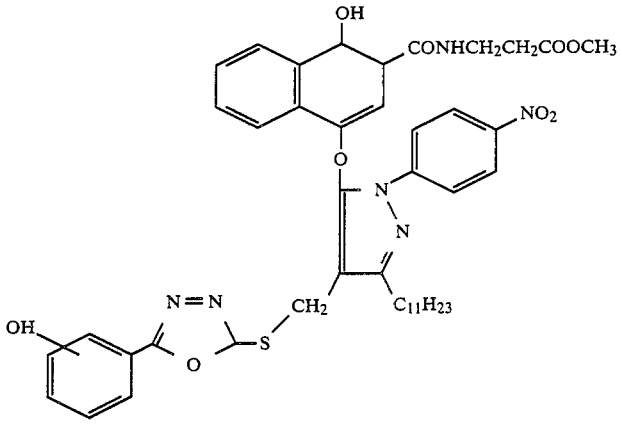
(19)
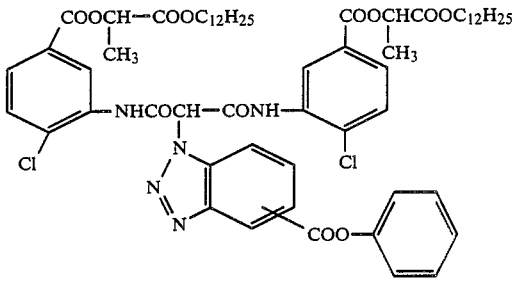
(20)
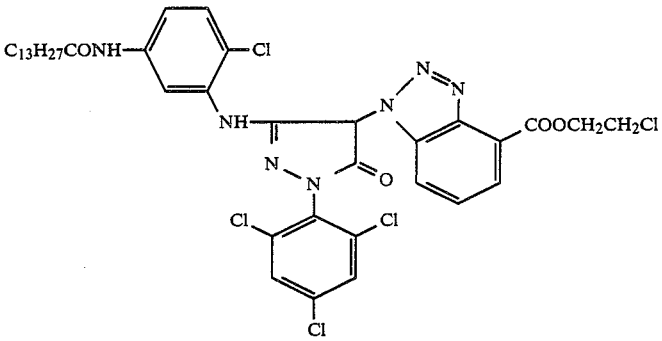
(21)
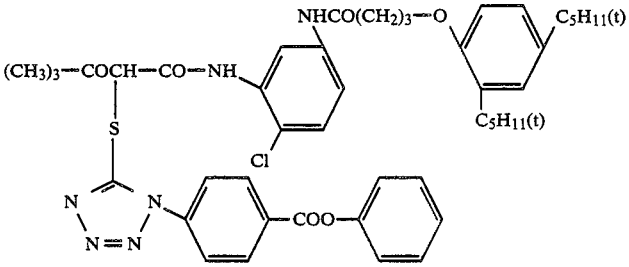

-continued (22)

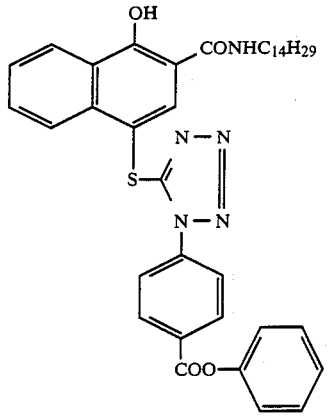

(23)

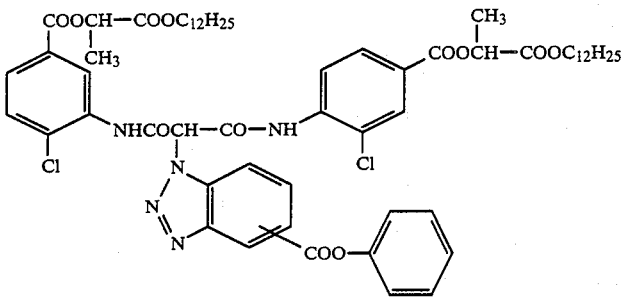

(24)

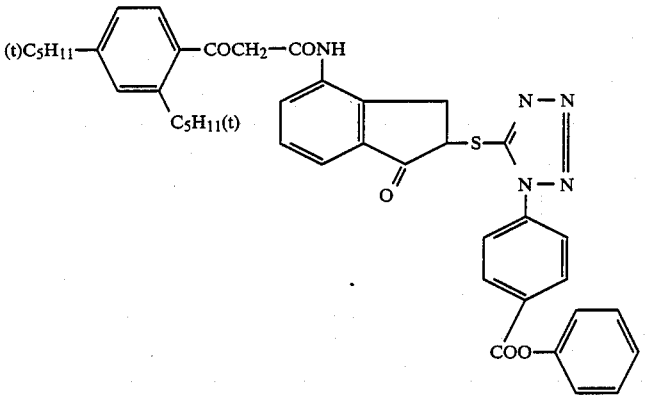

The couplers according to the present invention can be incorporated into light-sensitive materials by various known dispersions techniques, such as solid dispersion, alkali dispersion, and preferably latex dispersion, and more preferably oil-in-water dispersion. The oil-in-water dispersion technique is carried out by dissolving the coupler in a high-boiling organic solvent having a boiling point of 175° C. or higher and/or an auxiliary solvent having a low-boiling point and finely dispersing the solution in an aqueous medium, such as water or a gelatin aqueous solution, in the presence of a surface active agent. Examples of the high-boiling point organic solvent are described in U.S. Pat. No. 2,322,027. The dispersion may be accompanied by phase transfer. If desired, the auxiliary solvent used may be removed or reduced by distillation, noodle washing, or ultrafiltration prior to coating.

The details of latex dispersion and specific examples of latex for impregnation are described, e.g., in U.S. Pat. No. 4,199,363, West German Patent Application (OLS) Nos. 2,541,274 and 2,541,230.

Supports which can be used in the light-sensitive materials of the present invention are described in *Research Disclosure,* No. 17643 (Dec. 1978), p. 28 and ibid. No. 18716 (Nov. 1979), p. 647, right col. to p. 648, left col.

Silver halides to be used in photographic emulsion layers may be any of silver bromide, silver iodobromide, silver iodochlorobromide, silver chlorobromide, and silver chloride. Preferred silver halides are silver iodobromide and silver iodochlorobromide having a silver iodide content of not more than 30 mol %, with silver idobromide containing from about 2 to about 25 mol % of silver iodide being particularly preferred.

The silver halide grains may have a regular crystal form, such as a cubic, octahedral, or tetradecahedral form, an irregular crystal form, e.g., a spherical form, a crystal defect, e.g., a twinned crystal, or a composite form thereof. Tabular grains having an aspect ratio of about 5 or more (i.e., 5/1 or more) are particularly preferred in the present invention.

The silver halide grains may have a wide range of grain size of from about 0.1 μm to about 10 μm in projected area diameter. The photographic emulsion includes a mono-dispersed emulsion having narrow size distribution and a poly-dispersed emulsion having broad size distribution, with the former being particularly preferred in the present invention.

The monodisperse silver halide emulsion which can be used in the present invention typically includes an emulsion in which the silver halide grains have a mean grain size of about 0.1 μm or more, and preferably of from about 0.25 to about 2 μm, and at least about 95% by weight or number of the total grains falls within a size range 40%, and preferably 20%, of the mean grain size. Methods for preparing such a monodisperse emulsion are described in U.S. Pat. Nos. 3,574,628 and 3,655,394 and British Patent 1,413,748. In addition, monodisperse emulsions described in Japanese Patent Application (OPI) Nos. 8600/73, 39027/76, 83097/76, 137133/78, 48521/79, 99419/79, 37635/83, and 49938/83 can also be employed to advantage.

The aforesaid tabular grains having an aspect ratio of about 5 or more can be prepared easily by the methods described, e.g., in Gutoff, *Photographic Science and Engineerings,* Vol. 14, 248–257 (1970), U.S. Pat. Nos. 4,434,226, 4,414,310, 4,433,048, and 4,439,520, and British Pat. No. 2,112,157. Use of the tabular grains brings about improvements on efficiency of color sensitization due to sensitizing dyes, graininess, sharpness, and the like, as taught in U.S. Pat. No. 4,434,226, etc.

The individual silver halide grains may have either a homogeneous structure or a heterogeneous structure, such as a core-shell structure and a layered structure. These emulsion grains are disclosed in British Pat. No. 1,027,146, U.S. Pat. Nos. 3,505,068 and 4,444,877, and Japanese Patent Application (OPI) No. 143331/85. The grains may be fused to silver halide crystals having a different halogen composition or compounds other than silver halides, e.g., silver rhodanide, lead oxide, etc., by epitaxial bonding. These emulsion grains are disclosed in U.S. Pat. Nos. 4,094,684, 4,142,900, 4,459,353, 4,349,622, 4,395,478, 4,433,501, 4,463,087, 3,656,962, and 3,852,067, British Pat. No. 2,038,792, and Japanese Patent Application (OPI) No. 162540/84. Mixtures of various crystal forms may be used.

The photographic emulsion is usually subjected to physical ripening, chemical ripening, and spectral sensitization. Additives to be used in these steps and other photographic additives which can be used in the present invention are described in *Research Disclosure,* Nos. 17643 (Dec. 1978) and 18716 (Nov. 1979), etc.

The silver halide photographic emulsion to be used in the present invention can be prepared by conventionally known processes as described, e.g., in *Research Disclosure,* No. 17643, pp. 22–23 (Dec., 1978), "I. Emulsion Preparation and Types", ibid., No. 18716, p. 648 (Nov., 1979), P. Glafkides, *Chimie et Physique Photographique,* Paul Montel (1967), G. F. Duffin, *Photographic Emulsion Chemistry,* Focal Press (1966), V. L. Zelikman et al., *Making and Coating Photographic Emulsion,* The Focal Press (1964), etc. In some detail, the emulsion can be prepared by any of the acid process, the neutral process, the ammonia process, and the like. The reaction between a soluble silver salt and a soluble halogen salt is carried out by a single jet method, a double jet method, a combination thereof, and the like. A so-called reverse mixing method in which grains are produced in the presence of excess silver ions may be used. A so-called controlled double jet method, in which a pAg value of a liquid phase where silver halide grains are formed is maintained constant, may also be used. According to the controlled double jet method, a silver halide emulsion having a regular crystal form and a nearly uniform grain size can be obtained.

Two or more kinds of silver halide emulsions separately prepared may be used as a mixture.

The silver halide emulsion comprising the aforesaid regular crystals can be obtained by controlling pAg and pH values during grain formation. For details, reference can be made to it, e.g., in *Photographic Science and Engineering, Vol.* 6, pp. 159–165 (1962), *Journal of Photographic Science,* Vol. 12, pp. 242–251 (1964), U.S. Pat. No. 3,655,394 and British Pat. No. 1,413,748.

While, in general, couplers capable of releasing a development inhibitor upon coupling with an oxidation product of a developing agent like the compounds of formula (I) of the present invention are inclusively called DIR couplers, the compounds of formula (I) wherein a=0 are designated as "non-timing DIR couplers", and the compounds of formula (I) wherein a=1 are designated as "timing DIR couplers" in the present invention. On the other hand, the compounds of formula (I) wherein $Z_1$ has a residue of —$L_2$—Y—, i.e., the compounds of formula (II), are particularly designated as "development inhibitory activity inactivation type DIR couplers".

A combined use of the non-timing DIR couplers and other couplers is effective to further increase a high edge contrast of an exposed image in focus, while showing a tendency to soften the macro gradation. Of the non-timing DIR couplers, those releasable at a nitrogen atom are characterized by their effect of improving color separation by interlayer effect. On the other hand, the timing DIR couplers produce an effect to further decrease an edge contrast of an exposed image relatively out of focus, i.e., an image having a relatively low edge contrast. In cases where a light-sensitive layer, e.g., BL, GL, and RL, is divided in at least two; for example, where GL is composed of GL-O and GL-M, the timing DIR coupler can be incorporated into either one or both of GL-O and GL-M to smoothly broaden the gradation of GL. Further, the color separation from other layers, e.g., RL and BL, can be improved by using the non-timing DIR couplers in GL-O or GL-M. In particular, gradation at the toe of highlights can be improved by incorporating the non-timing DIR coupler in GL-O.

The effects produced by a combination of non-timing DIR couplers and timing DIR couplers, particularly in increasing micro contrast in the sharply focused image while decreasing contrast in the relatively unsharply focused image, are extremely advantageous for obtaining improved image quality, especially perspective and texture, by the photographic material package units according to the present invention. In the present invention, those DIR couplers which react with an oxidation product of a developing agent to form a colorless product or a yellow dye are particularly easy to use..

Further, it has been proved that combined use of a yellow coupler and a cyan-forming DIR coupler in BL is particularly effective to improve insufficient sharpness of RL according to the package unit of the invention.

The light-sensitive material package units of the present invention involve a disadvantage that the light-sensitive material is relatively liable to contact with the outer atmosphere upon removal of the outer package. It is particularly susceptible to harmful influences of formal dehyde gas from formalin). In order to eliminate the action of formalin, it is effective to use a compound selected from compounds represented by formulae (XXII), (XXIII), (XXIV), and (XXV) shown below as a formalin scavenger.

Formula (XXII) is represented by formula

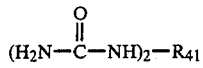

(XXII)

wherein $R_{41}$ represents an alkylene group.

Formula (XXIII) is represented by formula

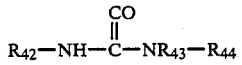

(XXIII)

wherein $R_{42}$ and $R_{43}$ each represents a hydrogen atom, an alkyl group, or

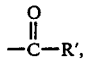

wherein R' represents an amino group or a substituted amino group; and $R_{44}$ represents an alkyl group or a substituted alkyl group; or $R_{42}$ and $R_{44}$ may be taken together to form a ring.

Formula (XXIV) is represented by formula

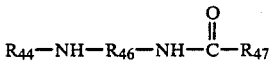

(XXIV)

wherein $R_{45}$ represents a hydrogen atom, an alkyl group or,

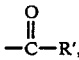

wherein R' is as defined above; $R_{46}$ represents a a carbonyl group or a carbimide group; and $R_{47}$ represents a substituted alkyl group, a substituted or unsubstituted amino group, a substituted or unsubsituted hydrocarbon residual group, or —OR'', wherein R'' represents a substituted or unsubstituted hydrocarbon residual group; or $R_{45}$ and $R_{47}$ are taken together to form a ring.

Formula (XXV) is represented by formula

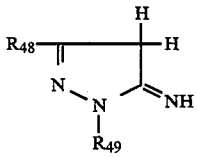

(XXV)

wherein $R_{48}$ represents a hydrogen atom, a substituted or unsubstitued alkyl group, a substituted or unsubstituted cyclohexyl group, a substituted or unsubstituted aralkyl group, a substituted or unsubstituted alkoxy group, a substituted or unsubstituted aryl group, a hydroxyl group, a substituted or unsubstituted carbamoyl group, a substituted or unsubstituted alkoxycarbonyl group, or a cyano group; and $R_{49}$ represents an alkyl group, a cyclohexyl group, a phenyl group, an aralkyl group, a heterocyclic group, a benzoyl group, a sulfonalkyl group, a sulfonaryl group, a carboxyalkyl group, a carbamoyl group, or a thiocarbamoyl group.

These formalin scavengers are known as described in Japanese Patent Application (OPI) Nos. 79248/83 and 73150/86. Specific examples of these compounds are shown below.

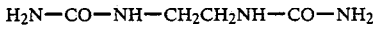

(51)

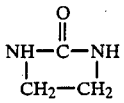

(52)

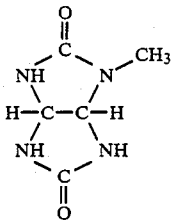

(53)

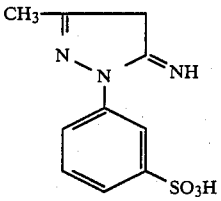

(54)

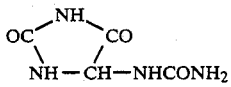

(55)

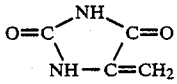

(56)

The formalin scavenger is preferably used in an amount of at least 50 mg/m$^2$, and more preferably at least 400 mg/m$^2$.

The color photographic material according to the present invention can be development-processed in usual manner as described in *Research Disclosure,* No. 17643, pp. 28–29 and ibid. No. 18716, p. 651, left to right columns.

The color developing solution to be used for color development preferably comprises an alkaline aqueous solution containing an aromatic primary amine color developing agent as a main component. The aromatic primary amine developing agent includes aminophenol compounds and p-phenylenediamine compounds, with the latter being preferred. Typical examples of the p-phenylenediamine compound are 3-methyl-4-amino-N,N-diethylaniline, 3-methyl-4-amino-N-ethyl-N-β-hydroxyethylaniline, 3-methyl-4-amino-N-ethyl-N-β-methanesulfonamidoethylaniline, 3-methyl-4-amino-N-ethyl-N-β-methoxyethylaniline, and sulfates, hydrochlorides or p-toluenesulfonates thereof. The salts of these diamine compounds are generally preferred to free compounds because of stability.

The color developing solution usually contains pH buffers, such as carbonates, borates or phosphates of alkali metals; and development restrainers or antifoggants, such as bromides, iodides, benzimidazoles, benzothiazoles, and mercapto compounds. If desired, the developing solution may further contain other various additives, such as preservatives, e.g., hydroxylamine, dihydroxyldialkylamine derivatives, sulfites, etc.; organic solvents, e.g., triethanolamine, diethylene glycol, etc.; development accelerators, e.g., benzyl alcohol, polyethylene glycol, quaternary ammonium salts, amines, etc.; color forming couplers; competing couplers, nucleating agents, e.g., sodium boron hydride, etc.; auxiliary developing agents, e.g., 1-phenyl-3-pyrazolidone, etc.; viscosity-imparting agents; chelating agents, e.g., aminopolycarboxylic acids, aminopolyphosphonic acids, alkylphosphonic acids, phosphonocarboxylic acids, etc.; antioxidants, e.g., those described in West German Patent Application (OLS) No. 2,622,950; and the like.

Color development of color reversal light-sensitive materials is generally preceded by black-and-white development. The black-and-white developing solution contains one or more of known black-and-white developing agents, such as dihydroxybenzenes, e.g., hydroquinone, 3-pyrazolidones, e.g., 1-phenyl-3-pyrazolidone, and aminophenols, e.g., N-methyl-p-aminophenol.

The photographic emulsion layers after color development processing is usually subjected to bleaching. The bleaching processing may be effected simultaneously with fixation, or these two steps may be carried out separately. In an attempt of speeding up of the processing, the bleaching processing may be followed by blix. Bleaching agents to be used include compounds of polyvalent metals, e.g., iron (III), cobalt (III), chromium (VI), copper (II), etc., peracids, quinones, nitroso compounds, and so on. Typical bleaching agents include ferricyanides; bichromates; organic complex salts of iron (III) or cobalt (III), such as complex salts with aminopolycarboxylic acids (e.g., ethylenediaminetetraacetic acid, diethylenetriaminepentaacetic acid, nitrilotriacetic acid, 1,3-diamino-2-propanoltetraacetic acid, etc.) or organic acids (e.g., citric acid, tartaric acid, malic acid, etc.); persulfates; permanganates; nitrosophenol; etc. Of these, ethylenediaminetetraacetate iron (III) salts, diethylenetriaminepentaacetate iron (III) salts and persulfates are preferred in view of rapid processing and conservation of the environment. The ethylenediaminetetraacetate iron (III) salts are particularly useful in both an independent bleach bath and a blix monobath.

If desired, the bleaching bath, blix bath, or prebath thereof can contain a bleaching accelerator. Examples of useful bleaching accelerators include compounds having a mercapto group or a disulfide group as described in U.S. Pat. No. 3,893,858, West German Pat. Nos. 1,290,812 and 2,059,988, Japanese Patent Application (OPI) Nos. 32736/78, 57831/78, 37418/78, 65732/78, 72623/78, 95630/78, 95631/78, 104232/78, 124424/78, 141623/78, and 28426/78, and *Research Disclosure,* No. 17129 (July, 1978); thiazolidine derivatives as described in Japanese Patent Application (OPI) No. 140129/75; thiourea derivatives as described in Japanese Patent Publication No. 8506/70, Japanese Patent Application (OPI) Nos. 20832/77 and 32735/78, and U.S. Pat. No. 3,706,561; iodides as described in West German Pat. No. 1,127,715 and Japanese Patent Application (OPI) No. 16235/83; polyethylene oxides as described in West German Pat. Nos. 966,410 and 2,748,430; polyamine compounds as described in Japanese Patent Publication No. 8836/70; the compounds described in Japanese Patent Application (OPI) Nos. 42434/74, 59644/74, 94927/78, 35727/79, 26506/80, and 163940/83; and iodine or bromine ions. Preferred among these bleaching accelerators are compounds having a mercapto group or a disulfide group, because of their high accelerating activity. In particular, the compounds disclosed in U.S. Pat. No. 3,893,858, West German Pat. No. 1,290,812, and Japanese Patent Application (OPI) No. 95630/78 are more preferred. In addition, the compounds disclosed in U.S. Pat. No. 4,552,834 are also preferred. These bleaching accelerators may be incorporated into the light-sensitive materials. The above-described bleaching accelerators are especially effective when the color light-sensitive materials are subjected to blix processing.

Fixing agents to be used for fixation include thiosulfates, thiocyanates, thioether compounds, thioureas, and a large quantity of iodides, with thiosulfates being commonly employed. Preservatives for the blix or fixing bath preferably include sulfites, bisulfites, and carbonyl-bisulfite adducts.

The blix or fixation is usually followed by washing or stabilization. Washing and stabilization baths can contain various known additives for the purpose of prevention of precipitation and water saving. Such additives include hard water softening agent for preventing precipitation, such as inorganic phosphoric acids, aminopolycarboxylic acids, organic aminopolyphosphonic acids, organic phosphoric acids, etc.; germicides or fungicides for preventing the propagation of bacteria, algae or fungi; metal salts exemplified by magnesium salts, aluminum salts and bismuth salts; surface active agents for reducing drying load or preventing uneven drying; and various film hardeners. In addition, the compounds described in L. E. West, *Photo. Sci. Eng.,* Vol. 6, 344–359 (1965) can also be used. Addition of the chelating agents and fungicides is particularly effective.

The washing step is generally carried out using two or more baths in a countercurrent system to achieve a water saving. The washing step may be replaced with a multi-stage countercurrent stabilization step. This step requires from 2 to 9 countercurrent baths. For the purpose of stabilizing an image, the stabilization bath contains various compounds in addition to the aforesaid additives, for example, buffering agents for film pH adjustment (e.g., to a pH of from 3 to 9) (e.g., borates, metaborates, borax, phosphates, carbonates, potassium hydroxide, sodium hydroxide, aqueous ammonia, monocarboxylic acids, dicarboxylic acids, polycarboxylic acids, and combinations thereof) and aldehydes (e.g., formaldehyde). If desired the stabilization both may further contain chelating agents (e.g., inorganic phosphoric acids, aminopolycarboxylic acids, organic phosphoric acids, organic phosphonic acids, aminopolyphosphonic acids, phosphonocarboxylic acids, etc.), germicides (e.g., benzoisothiazolinone, irithiazolone, 4-thiazoline-benzimidazole, halogenated phenols, sulfanilamide, benzotriazole, etc.), surface active agents, brightening agents, hardeners, and the like. These additives can be used in combinations thereof for the same or different purpose.

It is preferable to add, for film pH adjustment after processing, various ammonium salts, e.g., ammonium chloride, ammonium nitrate, ammonium sulfate, ammonium phosphate, ammonium sulfite, ammonium thiosulfate, etc.

It is possible to replace the washing-stabilization step usually conducted after fixation with the aforesaid stabilization step and washing step (water saving processing). In this case, if using a 2-equivalent magenta coupler, formalin may be excluded from the stabilization bath.

The time required for washing and stabilization usually ranges from 20 seconds to 10 minutes, and preferably from 20 seconds to 5 minutes, though varying depending on the kind of the light-sensitive material to be processed and the processing conditions.

For the purpose of simplification and speeding up of the processing, a color developing agent can be incorporated into the light-sensitive material. In this case, the color developing agent is preferably added in the form of its precursor. Precursors that can be incorporated include indoaniline compounds as described in U.S. Pat. No. 3,342,597, Schiff bases as described in U.S. Pat. No. 3,342,599 and *Research Disclosure,* Nos. 14850 (August 1976) and 15159 (November 1976), aldol compounds as described in *Research Disclosure,* No. 13924 (November 1975), metal salt complexes as described in U.S. Pat. No. 3,719,492, urethane compounds as described in Japanese Patent Application (OPI) No. 135628/78 and, in addition, various salt type compounds described in Japanese Patent Application (OPI) Nos. 6235/81, 16133/81, 59232/81, 67842/81, 83734/81, 83735/81, 83736/81, 89735/81, 81837/81, 54430/81, 10624/81, 107236/81, 97531/82, and 83565/82.

If desired, the silver halide color light-sensitive material of the present invention can further contain 1-phenyl-3-pyrazolidones for the purpose of color development acceleration. Typical examples of the 1-phenyl-3-pyrazolidone are described in japanese Patent Application (OPI) Nos. 64339/81, 144547/82, 211147/82, 50532/83 to 50536/83, and 15438/83.

Each of the above-mentioned processing solutions is employed at a temperature between 10° and 50° C., and commonly between 33° and 38° C. Higher temperatures can be used to accelerate processing for reduction in time, or lower temperatures can be used to improve image quality or stability of the processing solution.

In addition to the above-described processings, intensification can be carried out using a cobalt intensifier or a hydrogen peroxide intensifier in an attempt of saving silver to be used in the light-sensitive material, as described in West German Pat. No. 2,226,770 and U.S. Pat. No. 3,674,499.

Each of the processing baths can be equipped with a heater; a temperature sensor, a liquid level sensor, a circulating pump, a filter, a floating lid, a squeegee, etc., according to necessity.

In carrying out the photographic processing in a continuous manner, a constant finish can be assured by preventing fluctuations of processing solution compositions by means of replenishers. The amount of replenishers to be used may be reduced to half or less of a standard amount to be replenished for cost reduction purposes.

The light-sensitive material package unit having an exposure function in accordance with the present invention comprises an outer package, a box, and a case (i.e., a body) as shown in Japanese Utility Model Application Nos. 75091/86 and 75794/86. The case contains a film cartridge loaded with a light-sensitive material and is equipped with a simple optical lens, such as a plastic single lens and an aspherical lens, said optical lens being positioned at a site of the film to be exposed, a simple shutter mechanism, and a finder mechanism.

Since the package unit of this invention has an exposure function and is loaded with a light-sensitive material, one can take a photograph with it at any time of shutter opportunity without requiring film loading, and can obtain color prints simply by handing the exposed unit to photofinishing laboratories.

In general, light-sensitive materials having an ISO sensitivity of from about 100 to about 400 would be enough for outdoor photographing, but indoor photographing requires an ISO sensitivity of from about 400 to about 1600. The present invention makes it possible to obtain images having acceptable quality either by indoor photographing or outdoor photographing with the same kind of light-sensitive material.

The present invention is now illustrated in greater detail by way of the following examples, but it should be understood that the present invention is not limited thereto.

EXAMPLE 1

Preparation of Poly-Dispersed Emulsion

A silver nitrate aqueous solution and an alkali halide aqueous solution were spontaneously added into a rection vessel in which a gelatin aqueous solution and excess of a halide had been kept at 60° C. An aqueous solution of Demol N (produced by Kao Atlas Co., Ltd.) and a magnesium sulfate aqueous solution were added thereto to effect desalting by precipitation. An additional amount of gelatin was added thereto to obtain an emulsion having a pAg of 7.8 and a pH of 6.0.

The resulting emulsion was subjected to chemical ripening using sodium thiosulfate, chloroauric acid, and ammonium thiocyanate. 4-Hydroxy-6-methyl-1,3,3a,7-tetraazaindene and 6-nitrobenzimidazole were added to the emulsion, and gelatin was further added thereto to obtain a polydispersed silver iodobromide emulsion. In the above-described preparation, the halogen composition of the alkali halide was varied to obtain a prescribed silver iodide content (mol %); the feed rates of the silver nitrate and alkali halide aqueous solutions were varied to obtain a prescribed mean grain size ($\bar{\gamma}$; μm), grain size distribution (s) and degree of mono-dispersion ($s/\bar{\gamma}$); and the time of the chemical ripening was varied to obtain a prescribed sensitivity.

Preparation of Mono-Disperse Emulsion

To a reaction vessel in which potassium iodide and a gelatin aqueous solution had been charged, an ammoniac silver nitrate aqueous solution and a potassium bromide aqueous solution were added in amounts proportional to an increase of surface area of growing grains while automatically controlling the pAg and pH values. The Demol N aqueous solution and a magnesium sulfate aqueous solution were then added to the reaction system to effect desalting, and gelatin was further added thereto to obtain an emulsion having a pAg of 7.8 and a pH of 6.0.

The resulting emulsion was treated in the same manner as for the polydisperse emulsion to obtain a monodisperse silver iodobromide emulsion. In the preparation, a ratio of potassium iodide to potassium bromide was varied to obtain a prescribed silver iodide content (mol %); the amounts of the aqueous ammonia solution or ammoniac silver nitrate, and potassium halide were varied to obtain a prescribed grain size; and the time of the chemical ripening was varied to obtain a prescribed sensitivity.

Preparation of Light-Sensitive Material

On a transparent polyethylene terephthalate film support were coated the following layers in the order listed to obtain a color light-sensitive material.

1st Layer (AHL):

| | |
|---|---|
| Black colloidal silver | 0.2 g/m$^2$ |
| Gelatin | 1.0 g/m$^2$ |
| UV-1 (ultraviolet absorbent) | 0.2 g/m$^2$ |
| Oil-1 (dispersing oil) | 0.02 g/m$^2$ |

2nd Layer (ML):

| | |
|---|---|
| Silver bromide fine particles (silver content) ($\bar{\gamma}$: 0.07 μm) | 0.15 g of Ag/m$^2$ |
| Gelatin | 1.0 g/m$^2$ |

3rd Layer (RL-U):

A silver iodorbromide emulsion was mixed with Sensitizing Dyes A and B, and the thus sensitized emulsion was mixed with Couplers C-1, 2, and 3 and couplers according to the present invention C-4 and C-5. The mixture was dispersed in a mixed solvent of Oil-1 and Oil-2 to prepare a coating composition having the following formulation.

| | |
|---|---|
| Silver iodobromide emulsion A (silver iodide: 2 mol %; $\bar{\gamma}$: 0.3 μm; s/$\bar{\gamma}$: 0.33) | 0.7 g of Ag/m$^2$ |
| Gelatin | 0.9 g/m$^2$ |
| Sensitizing Dye A | $1.0 \times 10^{-4}$ mol/mol-Ag |
| Sensitizing Dye B | $2.0 \times 10^{-4}$ mol/mol-Ag |
| Coupler C-1 | 0.3 g/m$^2$ |
| Coupler C-2 | 0.3 g/m$^2$ |
| Coupler C-3 | 0.2 g/m$^2$ |
| Coupler C-4 | 0.02 g/m$^2$ |
| Coupler C-5 | 0.01 g/m$^2$ |
| Oil-1 | 0.1 g/m$^2$ |
| Oil-2 | 0.1 g/m$^2$ |

4th Layer (RL-0):

A coating composition of the following formulation was prepared in the same manner as for the 3rd layer.

| | |
|---|---|
| Monodisperse silver iodobromide emulsion B (silver iodide: 5 mol %; $\bar{\gamma}$: 0.7 μm; s/$\bar{\gamma}$: 0.08) | 1.0 g of Ag/m$^2$ |
| Gelatin | 1.0 g/m$^2$ |
| Sensitizing Dyes A | $3 \times 10^{-4}$ mol/mol-Ag |
| Sensitizing Dye B | $2 \times 10^{-4}$ mol/mol-Ag |
| Coupler C-1 | 0.01 g/m$^2$ |
| Coupler C-2 | 0.05 g/m$^2$ |
| Coupler C-3 | 0.03 g/m$^2$ |
| Coupler C-6 | 0.02 g/m$^2$ |
| Coupler C-7 | 0.02 g/m$^2$ |
| Coupler C-8 | 0.02 g/m$^2$ |
| Coupler C-9 (coupler of the present invention) | 0.02 g/m$^2$ |
| Oil-2 | 0.1 g/m$^2$ |

5th Layer (ML):

Compound A was dissolved in a gelatin aqueous solution, and the solution was dispersed in Oil-2 to prepare a coating composition having the following formulation.

| | |
|---|---|
| Gelatin | 1.0 g/m$^2$ |
| Compound A | 0.05 g/m$^2$ |
| Oil-2 | 0.05 g/m$^2$ |

The resulting light-sensitive material was designated as Sample 1.

Comparative Sample 1′ was prepared in the same manner as for Sample 1, except for excluding Couplers C-4 and C-5 from the 3rd layer (RL-U), changing the amount of Coupler C-1 in the 3rd layer to 0.35 g/m$^2$, replacing silver iodobromide emulsion B in the 4th layer (RL-O) with a polydisperse silver iodobromide emulsion having an equal sensitivity (silver iodide: 5 mol %; $\bar{\gamma}$: 0.7 μm; s/$\bar{\gamma}$: 0.33) excluding Coupler C-9 from the 4th layer, and changing the amount of Coupler C-1 in the 4th layer to 0.03 g/m$^2$.

Each of Samples 1 and 1′ was exposed to light through a discontinuous red filter using a tungsten lamp at a color temperature of 4800°K, and the exposed sample was subjected to development processing according to the following procedure.

| | |
|---|---|
| Color Development (38° C.) | 3 min 15 sec |
| Bleaching | 6 min 30 sec |
| Washing with water | 2 min 10 sec |
| Fixing | 4 min 20 sec |
| Washing with water | 3 min 15 sec |
| Stabilization | 1 min 05 sec |

The processing solutions used in the development processing had the following formulations.

Formulation of Color Developing Solution:

| | |
|---|---|
| Diethylenetriaminepentaacetic acid | 1.0 g |
| 1-Hydroxyethylidene-1,1-diphosphonic acid | 2.0 g |
| Sodium sulfite | 4.0 g |
| Potassium carbonate | 30.0 g |
| Potassium bromide | 1.4 g |
| Potassium iodide | 1.3 mg |
| Hydroxylamine sulfate | 2.4 g |
| 4-(N—Ethyl-N—β-hydroxyethylamino)-2-methylaniline sulfate | 4.5 g |
| Water to make | 1.0 l |
| | pH =10.0 |

Formulation of Bleaching Solution:

| | |
|---|---|
| Ammonium (ethylenediaminetetraacetate)ferrite | 100.0 g |
| Disodium ethylenediaminetetraacetate | 10.0 g |
| Ammonium bromide | 150.0 g |
| Ammonium nitrate | 10.0 g |
| Water to make | 1.0 l |
| | pH =6.0 |

Formulation of Fixing Solution:

| | |
|---|---|
| Disodium ethylenediaminetetraacetate | 1.0 g |
| Sodium sulfite | 4.0 g |
| Ammonium thiosulfate (70 wt % aqueous solution) | 175.0 ml |
| Sodium bisulfite | 4.6 g |
| Water to make | 1.0 l |

Formulation of Stabilizing Solution:

| | |
|---|---|
| Formalin (40 wt % formaldehyde) | 2.0 ml |

-continued

| | |
|---|---|
| Polyoxyethylene-p-monononyl phenyl ether (average degree of polymerization: 10) | 0.3 g |
| Water to make | 1.0 l |

The characteristic curves obtained from Sample 1 and Comparative Sample 1′ are shown in FIG. 1, in which both curves are plotted so that the toes overlap each other.

As can be seen from FIG. 1, Curve 1 for Sample 1 shows a softer gradation, a linearity, and an excellent gradation at the toe as compared with Curve 1′ for Comparative Sample 1′.

EXAMPLE 2

On a transparent polyethylene terephthalate film support were coated 1st to 5th layers having the same compositions as used in Sample 1 of Example 1 and then 6th to 13th layers having the following compositions in the order listed.

6th Layer (GL-U):

| | |
|---|---|
| Monodisperse silver iodobromide emulsion C (silver iodide: 3 mol %; $\bar{\gamma}$: 0.2 μm; s/$\bar{\gamma}$: 0.09) | 0.2 g of Ag/m$^2$ |
| Monodisperse silver iodobromide emulsion D (silver iodide: 6 mol %; $\bar{\gamma}$: 0.6 μm; s/$\bar{\gamma}$: 0.10) | 0.4 g of Ag/m$^2$ |
| Gelatin | 1.0 g/m$^2$ |
| Sensitizing Dye C | $3 \times 10^{-4}$ mol/mol-Ag |
| Sensitizing Dye D | $2 \times 10^{-4}$ mol/mol-Ag |
| Coupler C-10 | 0.4 g/m$^2$ |
| Coupler C-11 | 0.1 g/m$^2$ |
| Coupler C-12 | 0.02 g/m$^2$ |
| Coupler C-13 of Invention | 0.01 g/m$^2$ |
| Oil-2 | 0.05 g/m$^2$ |

7th Layer (GL-O):

| | |
|---|---|
| Polydisperse silver iodobromide emulsion (silver iodide: 7 mol %; $\bar{\gamma}$: 0.8 μm; s/$\bar{\gamma}$: 0.29) | 0.9 g of Ag/m$^2$ |
| Gelatin | 0.9 g/m$^2$ |
| Sensitizing Dye C | $2 \times 10^{-4}$ mol/mol-Ag |
| Sensitizing Dye D | $1.5 \times 10^{-4}$ mol/mol-Ag |
| Coupler C-12 | 0.08 g/m$^2$ |
| Coupler C-14 | 0.05 g/m$^2$ |
| Oil-1 | 0.08 g/m$^2$ |
| Oil-3 | 0.03 g/m$^2$ |

8th Layer (MC):

| | |
|---|---|
| Gelatin | 1.2 g/m$^2$ |
| Compound A | 0.6 g/m$^2$ |
| Oil-1 | 0.3 g/m$^2$ |

9th Layer (YFL):

| | |
|---|---|
| Yellow colloidal silver | 0.2 g/m$^2$ |
| Gelatin | 0.8 g/m$^2$ |
| Compound A | 0.2 g/m$^2$ |
| Oil-1 | 0.1 g/m$^2$ |

10th Layer (BL-U):

| | |
|---|---|
| Monodisperse silver iodobromide emulsion E (silver iodide: 6 mol %; $\bar{\gamma}$: 0.3 μm; s/$\bar{\gamma}$: 0.12) | 0.2 g of Ag/m$^2$ |
| Monodisperse silver iodobromide emulsion F (silver iodide: 5 mol %; $\bar{\gamma}$: 0.6 μm; s/$\bar{\gamma}$: 0.09) | 0.4 g of Ag/m$^2$ |
| Gelatin | 0.1 g/m$^2$ |
| Sensitizing Dye E | $1 \times 10^{-4}$ mol/mol-Ag |
| Sensitizing Dye F | $1 \times 10^{-4}$ mol/mol-Ag |
| Coupler C-15 | 0.9 g/m$^2$ |
| Coupler C-13 of Invention | 0.05 g/m$^2$ |
| Oil-3 | 0.01 g/m$^2$ |

11th Layer (BL-O):

| | |
|---|---|
| Monodisperse silver iodobromide emulsion G (silver iodide: 8 mol %; $\bar{\gamma}$: 1.5 μm; s/$\bar{\gamma}$: 0.08) | 0.5 g of Ag/m$^2$ |
| Gelatin | 0.5 g/m$^2$ |
| Sensitizing Dye E | $5 \times 10^{-5}$ mol/mol-Ag |
| Sensitizing Dye F | $5 \times 10^{-5}$ mol/mol-Ag |
| Coupler C-15 | 0.5 g/m$^2$ |
| Coupler C-13 of the present invention | 0.05 g/m$^2$ |
| Oil-3 | 0.01 g/m$^2$ |

12th Layer (PC-1):

| | |
|---|---|
| Gelatin | 0.5 g/m$^2$ |
| Coupler C-16 | 0.5 g/m$^2$ |
| UV-1 | 0.1 g/m$^2$ |
| UV-2 | 0.1 g/m$^2$ |
| Oil-4 | 0.01 g/m$^2$ |

13th Layer (PC-2):

| | |
|---|---|
| Ultra-fine silver iodobromide emulsion (silver iodide: 5 mol %; $\bar{\gamma}$: 0.07 μm) | 0.25 g of Ag/m$^2$ |
| Gelatin | 0.5 g/m$^2$ |
| Polymethyl methacrylate grains ($\bar{\gamma}$: 1.5 μm) | 0.2 g/m$^2$ |
| Formalin Scavenger S-1 | 0.6 g/m$^2$ |

Each of the above layers further contained W-1 (surface active agent) and H-1 (hardener).

The compounds used in the sample preparations are shown below.

Sensitizing Dye A:

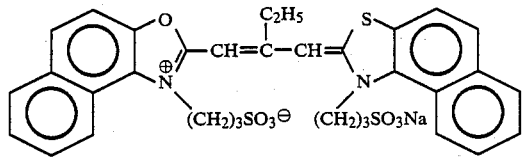

Sensitizing Dye B:

-continued
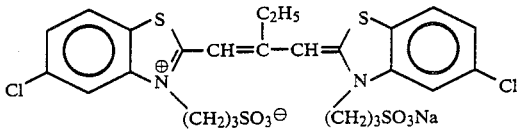
Sensitizing Dye C:
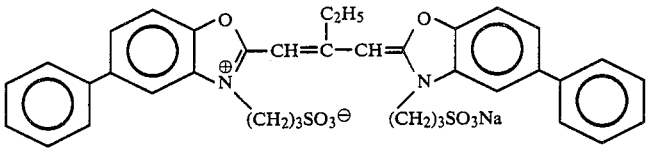
Sensitizing Dye D:
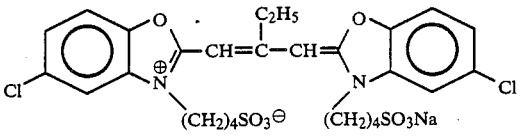
Sensitizing Dye E:
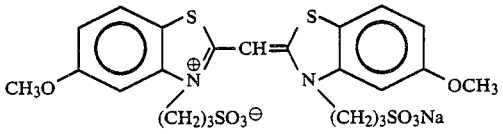
Sensitizing Dye F:
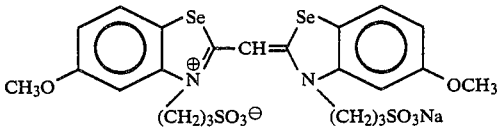
Coupler C-1:
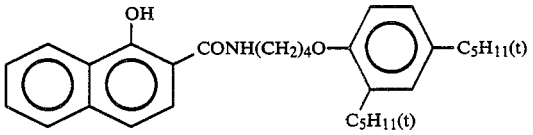
Coupler C-2:
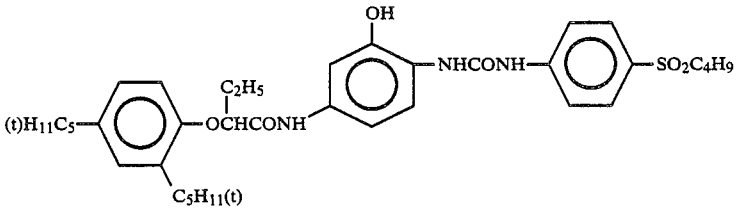
Coupler C-3:

-continued
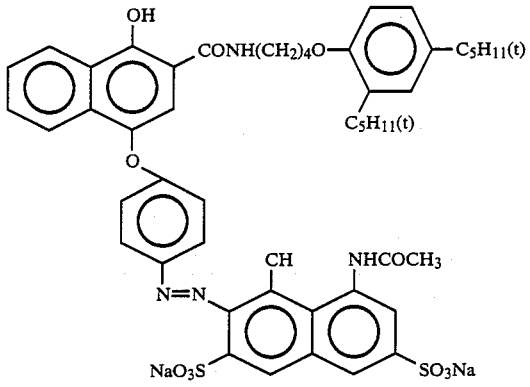
Coupler C-4:
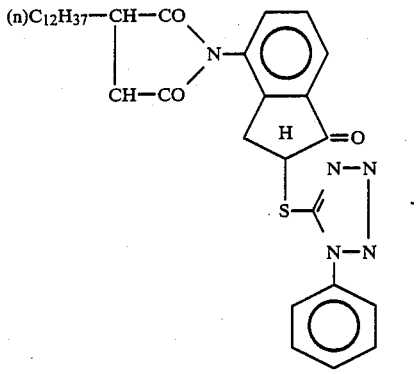
Coupler C-5:
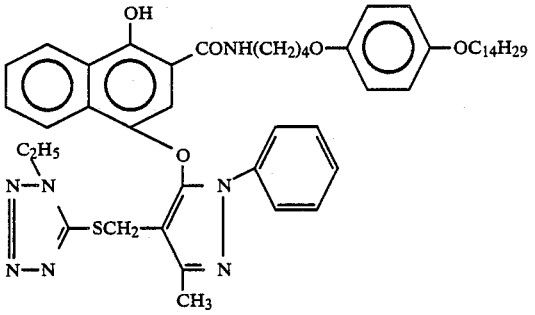
Coupler C-6:
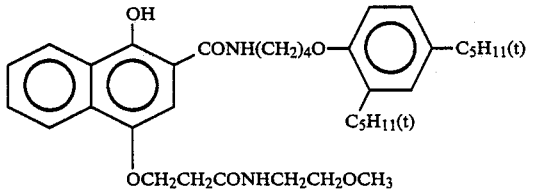
Coupler C-7:

-continued
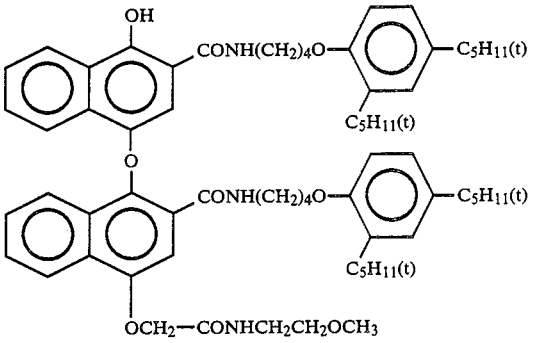
Coupler C-8:
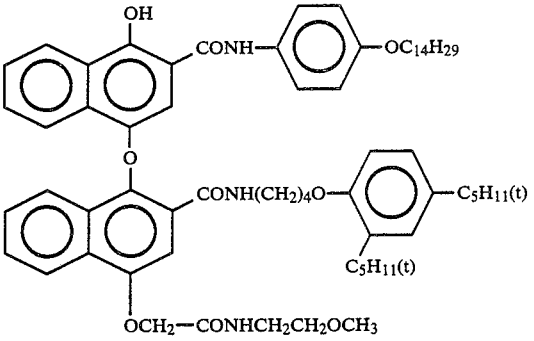
Coupler C-9:
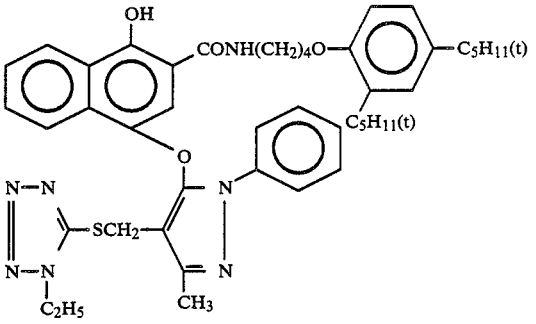
Coupler C-10:
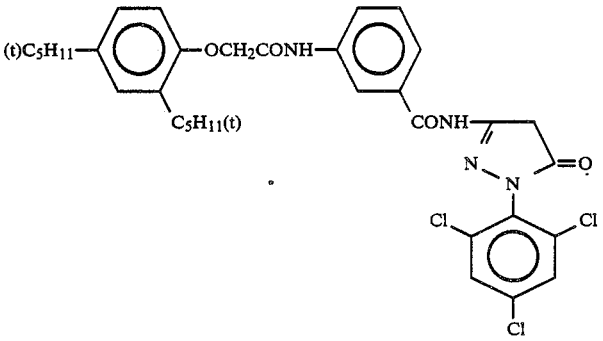
Coupler C-11:

-continued
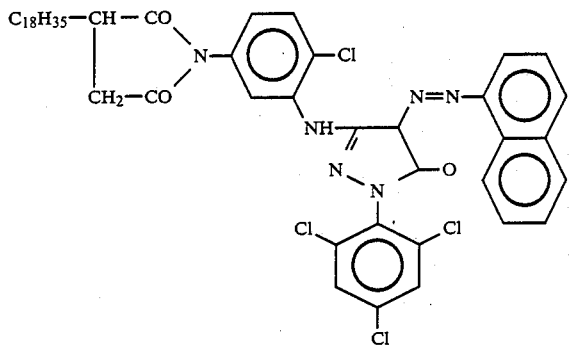
Coupler C-12:
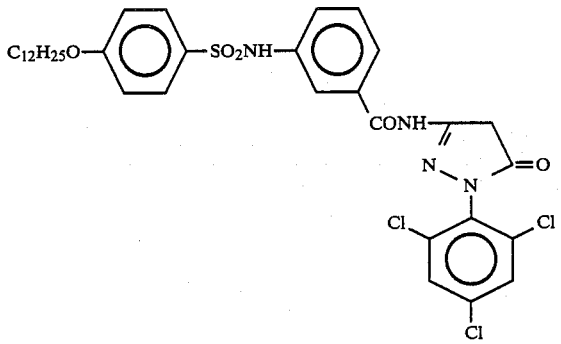
Coupler C-13:
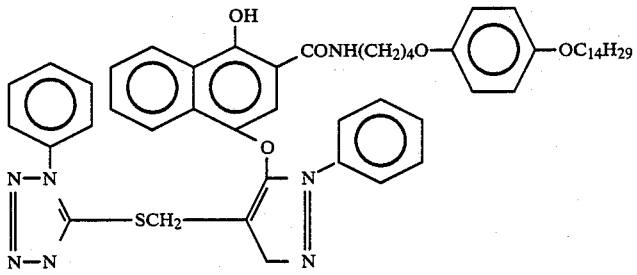
Coupler C-14:
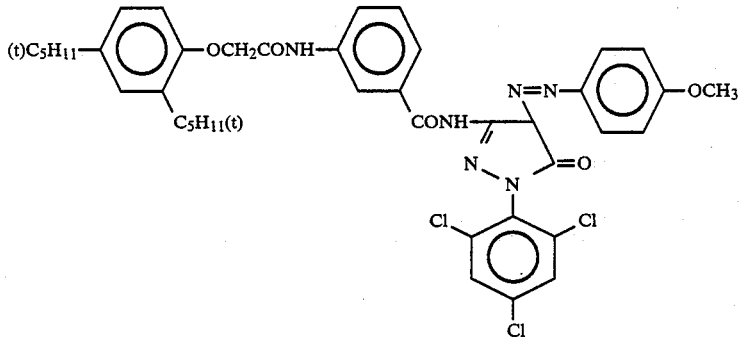
Coupler C-15:

-continued
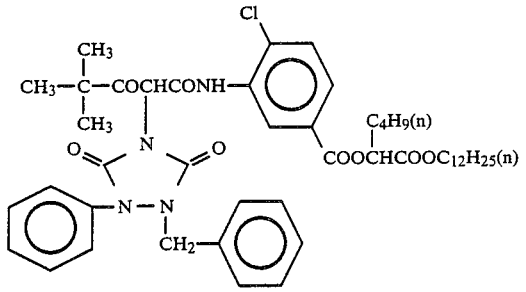
Coupler C-16:
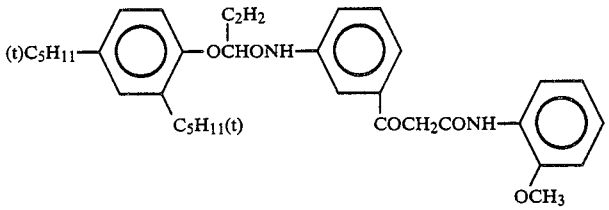
Surface Active Agent W-1:
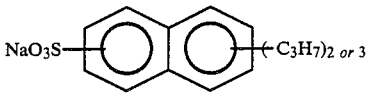
Formalin Scavenger S-1:
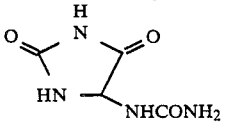
Dispersing Oil Oil-1:
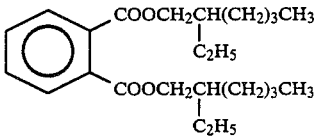
Dispersing Oil Oil-2:
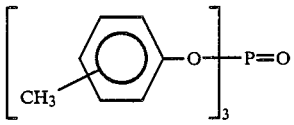
Dispersing Oil Oil-3:
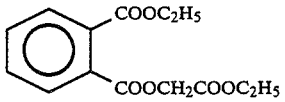
Dispersing Oil Oil-4:
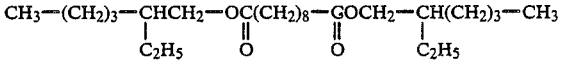
Ultraviolet Absorbent UV-1:
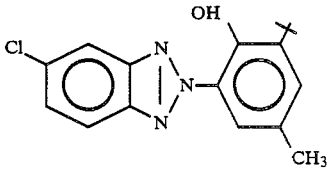
Ultraviolet Absorbent UV-2:

-continued

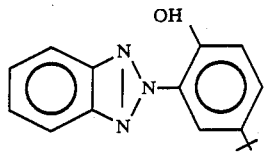

Ultraviolet Absorbent UV-3:

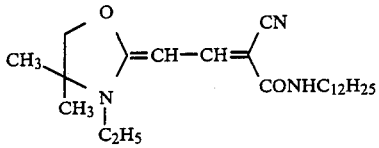

Compound A:

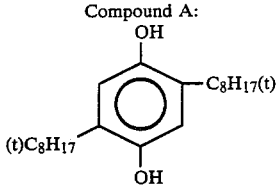

Hardener H-1:
1,4-Bis(vinylsulfonacetamido)ethane

The thus prepared sample was designated as Sample 2.

Comparative Sample 2′ was prepared in the same manner as for Sample 2, except for replacing the monodisperse silver iodobromide emulsions C and D in the 6th layer with a polydisperse silver iodobromide emulsion (silver iodide: 5 mol %; $\bar{\gamma}$0.35 μm; s/$\bar{\gamma}$: 0.29) in an amount of 0.6 g of Ag/m$^2$, replacing the mono-disperse silver iodobromide emulsions E and F in the 10th layer with a polydisperse silver iodobromide emulsion (silver iodide: 5.5 mol %; $\bar{\gamma}$: 0.4 μm; s/$\bar{\gamma}$: 0.26) in an amount of 0.6 g of Ag/m$^2$, replacing the monodisperse silver iodobromide emulsion in the 11th layer with a polydisperse silver iodobromide emulsion (silver iodide: 8 mol %; $\bar{\gamma}$: 1.2 μm; s/$\bar{\gamma}$: 0.29), and excluding Coupler C-13 from the 6th, 10th, and 11th layer.

Twenty package units were prepared using each of Sample 2 and Sample 2′ in accordance with the present invention. In addition, the samples were preserved at 50° C. for 3 days to prepare package units for testing of accelerated deterioration.

Each of the 40 package units was exposed to sunshine to take a photgraph of a chart for MTF (modulation transfer frequency) measurement placed at a distance of about 3.6 m from the package unit on a horizontal line with respect to the package unit, and the exposed film was development-processed in the same manner as in Example 1 to obtain a negative original. The negative original was printed on an enlarging paper (82.5 mm × 120 mm) in a usual manner. The enlargement ratio was about 6.7. The film was determined for sharpness in terms of definition. A definition of from 4 to 5 lines per mm at a density damping factor of MTF of 0.5 was taken as an acceptable criterion for sharpness.

Eighteen out of 20 package units loaded with Sample 2 showed good results exceeding the acceptable criterion, while nothing but two of 20 package units loaded with Sample 2′ could pass the acceptance limit. Further, the package units loaded with Sample 2 exhibited good color balance and showed a trend of soft and broad gradation. On the other hand, the package units loaded with Sample 2′ suffered from color impurity, particularly of magenta and cyan colors, and lacked gradation in the shadows, only to provide a poor image.

EXAMPLE 3

Samples 3, 4, and 5 were prepared in the same manner as for Sample 2 of Example 2, except that the 12th layer (PC-1) further contained 800 mg/m$^2$ of Formalin Scavenger S-1, S-2, or S-3. For comparsion, Sample 3′ was prepared in the same manner as for Sample 2, except for excluding S-1 from the 13th layer.

Formalin Scavenger S-2:

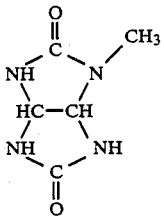

Formalin Scavenger S-3:

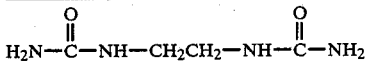

Each of Samples 2 of Example 2, Samples 3 to 5, and Comparative Sample 3′ was cut into strips and loaded in a film cartridge. The film cartridge was packed in a packaging case to produce package units according to the present invention. The package units were put in a box coated with a formalin resin, and the boxes were allowed to stand in a thermostat at 40° C. and 75% RH for 7 days. The atmosphere in the thermostat had a formldehyde gas concentration of from 50 to 100 ppm.

Each of the samples was wedgewise exposed to light through a green filter in the same manner as in Example 1, and the results obtained are shown in Table 1 below.

TABLE 1

| Sample No. | Formalin Scavenger | Green Density (DG)* |
|---|---|---|
| 3' | not used | 2.8 |
| 2 | S-1 | 3.5 |
| 3 | S-1 | 3.5 |
| 4 | S-2 | 3.7 |
| 5 | S-3 | 3.6 |

Note:
*Magenta density at the same Log E point.

It can be seen from Table 1 that addition of formalin scavengers according to the present invention is effective to prevent reduction of color density, particularly magneta color, and stain formation.

EXAMPLE 4

Sample 6 was prepared in the same manner as for Sample 2 of Example 2, except for replacing Coupler C-13 in the 10th and 11th layers with 0.05 g/m$^2$ of Coupler C-4. Light-sensitive material package units were prepared using each of Sample 2 and Sample 6 in the same manner as in Example 3.

Each of the units was exposed to sunshine to take a photograph of a chart for MTF measurement placed at about 3.0 m from the unit on the horizontal line with respect to the unit to obtain a negative original.

The negative original was measured with respect to MTF using a red filter. Spatial frequency of Sample 2 at a damping factor of MTF of 0.5 was about 25 c/mm, while that of Sample 6 was about 20 c/mm, apparently demonstrating that Sample 2 is superior to Sample 6 in sharpness of the cyan image.

EXAMPLE 5

Silver Halide Emulsions I to XXVI were prepared in the same manner as described in Example 1 so as to have prescribed iodide content, mean grain size ($\bar{\gamma}$), and degree of mono-dispersion ($s/\bar{\gamma}$) or aspect ratio in the case of using tabular emulsion grains as shown in Table 2 below.

TABLE 2

| Layer | Emulsion No. | Iodide Content (mol %) | $\bar{\gamma}$ (μm) | $s/\bar{\gamma}$ |
|---|---|---|---|---|
| 3rd (RL-U) | I | 5 | 0.60 | 0.09 |
| " | II | 5 | 0.12 | 0.11 |
| " | III | 5 | 0.35 | 0.35 |
| " | IV | 5 | 0.6 | 0.09 |
| " | V | 5 | 0.2 | 0.11 |
| 4th (RL-O) | IV | 4 | 0.7 | 0.16 |
| 6th (GL-O) | VII | 5 | 0.5 | 0.10 |
| " | VIII | 5 | 0.2 | 0.09 |
| " | IX | 5 | 0.3 | 0.30 |
| " | X | 5 | 0.5 | 0.10 |
| " | XI | 5 | 0.2 | 0.09 |
| 7th (GL-U) | XII | 4 | 0.2 | 0.15 |
| " | XIII | 3 | 1.5 | 7.5* |
| " | XIV | 4 | 0.7 | 0.15 |
| 10th (BL-U) | XV | 7 | 0.3 | 0.09 |
| " | XVI | 7 | 0.1 | 0.11 |
| " | XVII | 7 | 0.5 | 0.33 |
| " | XVIII | 7 | 0.3 | 0.09 |
| " | XIX | 7 | 0.1 | 0.11 |
| 10th (BL-O) | XX | 3 | 1.0 | 7.5* |
| " | XXI | 3 | 0.1 | 7.5* |
| " | XXII | 7 | 0.3 | 0.09 |
| " | XXIII | 7 | 0.1 | 0.11 |
| 11th (BL-O) | XXIV | 7 | 1.2 | 0.12 |
| " | XXV | 3 | 2.0 | 7.5* |
| " | XXVI | 7 | 1.2 | 0.12 |

Note:
*Aspect ratio

In order to demonstrate combined effects of the monodisperse emulsion, DIR coupler, and formalin scavenger according to the present invention, Samples 7 to 23 were prepared in the same manner as in Example 2, except that the kind or amount of silver halide emulsion and couplers were changed as shown in Table 3 below, and 200 package units were produced per each sample.

A hundred out of 200 units per sample were exposed to light in the same manner as in Example 2, except that it was a cloudy day, and were developed and printed in the same manner as in Example 2 (Test I). Further, the other hundred units per sample were subjected to formalin test in the same manner as in Example 3 and then exposed to light in the same manner as described above (Test II). The number of units out of each 100 units which fulfilled the acceptable criterion for sharpness is shown in Table 3.

TABLE 3

| Layer | Component | Sample No. 7 | 8 | 9 | 10 | 11 | 12 | 13 | 14 | 15 | 16 | 17 | 18 | 19 | 20 | 21 | 22 | 23 |
|---|---|---|---|---|---|---|---|---|---|---|---|---|---|---|---|---|---|---|
| 1st | | The same as Example 1. | | | → | → | → | → | → | → | → | → | → | → | → | → | → | → |
| 2nd | | The same as Example 1. | | | → | → | → | → | → | → | → | → | → | → | → | → | → | → |
| 3rd | I | 0.3 | 0.3 | 0.3 | 0.3 | 0.3 | 0.3 | — | — | — | — | — | — | — | — | — | — | — |
| | II | 0.4 | 0.4 | 0.4 | 0.4 | 0.4 | 0.4 | — | — | — | — | — | — | — | — | — | — | — |
| | III | — | — | — | — | — | — | 0.7 | 0.7 | 0.7 | 0.7 | — | — | — | — | — | — | — |
| | IV | — | — | — | — | — | — | — | — | — | — | 0.3 | 0.3 | 0.3 | 0.3 | 0.3 | 0.3 | 0.3 |
| | V | — | — | — | — | — | — | — | — | — | — | 0.4 | 0.4 | 0.4 | 0.4 | 0.4 | 0.4 | 0.4 |
| | C-1 | The same as in example 1. | | | → | → | → | → | → | → | → | → | → | → | → | → | → | → |
| | C-2 | The same as in example 1 | → | → | → | → | → | → | → | → | → | → | → | → | → | → | → | → |
| | C-3 | The same as in example 1 | → | → | → | → | → | → | → | → | → | → | → | → | → | → | → | → |
| | C-13 | 0.03 | 0.03 | 0.03 | — | 0.03 | 0.03 | 0.03 | 0.03 | 0.03 | — | 0.03 | 0.03 | 0.03 | 0.03 | 0.03 | 0.03 | 0.03 |
| | C-4 | 0.01 | 0.01 | 0.01 | 0.04 | 0.01 | 0.01 | 0.01 | 0.01 | 0.01 | 0.04 | 0.01 | 0.01 | 0.01 | 0.01 | 0.01 | 0.01 | 0.01 |
| | Others* | The same as in Example 1. | | | | → | → | → | → | → | → | → | → | → | → | → | → | → |
| 4th | VI | 1.0 | 1.0 | 1.0 | 1.0 | 1.0 | 1.0 | 1.0 | 1.0 | 1.0 | 1.0 | 1.0 | 1.0 | 1.0 | 1.0 | 1.0 | 1.0 | 1.0 |
| | Others* | The same as in Example 1. | | | | → | → | → | → | → | → | → | → | → | → | → | → | → |
| 5th | | The same as in Example 1. | | | → | → | → | → | → | → | → | → | → | → | → | → | → | → |
| 6th | VII | 0.2 | 0.2 | 0.2 | 0.2 | 0.2 | — | — | — | — | — | — | — | — | — | — | — | — |
| | VIII | 0.4 | 0.4 | 0.4 | 0.4 | 0.4 | — | — | — | — | — | — | — | — | — | — | — | — |

TABLE 3-continued

| Layer | Component | Sample No. 7 | 8 | 9 | 10 | 11 | 12 | 13 | 14 | 15 | 16 | 17 | 18 | 19 | 20 | 21 | 22 | 23 |
|---|---|---|---|---|---|---|---|---|---|---|---|---|---|---|---|---|---|---|
| | IX | — | — | — | — | — | 0.6 | 0.6 | 0.6 | 0.6 | 0.6 | — | — | — | — | — | — | — |
| | X | — | — | — | — | — | — | — | — | — | — | 0.2 | 0.2 | 0.2 | 0.2 | 0.2 | 0.2 | 0.2 |
| | XI | — | — | — | — | — | — | — | — | — | — | 0.4 | 0.4 | 0.4 | 0.4 | 0.4 | 0.4 | 0.4 |
| | C-10 | 0.1 | 0.1 | 0.1 | 0.1 | 0.1 | 0.1 | 0.1 | 0.1 | 0.1 | 0.1 | — | 0.1 | 0.1 | 0.1 | 0.1 | 0.1 | 0.1 |
| | C-11 | 0.1 | 0.1 | 0.1 | 0.1 | 0.1 | 0.1 | 0.1 | 0.1 | 0.1 | 0.1 | — | 0.1 | 0.1 | 0.1 | 0.1 | 0.1 | 0.1 |
| | C-12 | 0.02 | 0.02 | 0.02 | 0.02 | 0.02 | 0.02 | 0.02 | 0.02 | 0.02 | 0.02 | — | 0.02 | 0.02 | 0.02 | 0.02 | 0.02 | 0.02 |
| | C-18 | 0.3 | 0.3 | 0.3 | 0.3 | 0.3 | 0.3 | 0.3 | 0.3 | 0.3 | 0.3 | — | 0.3 | 0.3 | 0.3 | 0.3 | 0.3 | 0.3 |
| | C-17 | 0.05 | 0.05 | — | 0.05 | 0.05 | 0.05 | 0.05 | 0.05 | — | — | 0.05 | 0.05 | 0.05 | 0.05 | 0.05 | 0.05 | 0.05 |
| | C-4 | — | — | 0.05 | — | — | — | — | — | 0.05 | 0.05 | — | — | — | — | — | — | — |
| | Others* | The same as in Example 2. | | | | → | → | → | → | → | → | → | → | → | → | → | → | → |
| 7th | XII | 0.9 | 0.9 | 0.9 | 0.9 | 0.9 | 0.9 | 0.9 | 0.9 | 0.9 | 0.9 | 0.9 | 0.9 | 0.9 | 0.9 | — | — | — |
| | XIII | — | — | — | — | — | — | — | — | — | — | — | — | — | — | 0.9 | — | — |
| | XIV | — | — | — | — | — | — | — | — | — | — | — | — | — | — | — | 0.9 | 0.9 |
| | C-12 | 0.04 | 0.04 | 0.04 | 0.04 | 0.04 | 0.04 | 0.04 | 0.04 | 0.04 | 0.04 | 0.04 | 0.04 | 0.04 | 0.04 | 0.04 | 0.04 | 0.04 |
| | C-14 | 0.05 | 0.05 | 0.05 | 0.05 | 0.05 | 0.05 | 0.05 | 0.05 | 0.05 | 0.05 | 0.05 | 0.05 | 0.05 | 0.05 | 0.05 | 0.05 | 0.05 |
| | C-18 | 0.04 | 0.04 | 0.04 | 0.04 | 0.04 | 0.04 | 0.04 | 0.04 | 0.04 | 0.04 | 0.04 | 0.04 | 0.04 | 0.04 | 0.04 | 0.04 | 0.04 |
| | Others* | The same as in Example 2. | | | | → | → | → | → | → | → | → | → | → | → | → | → | → |
| 8th | The same as Example 2. | | | | → | → | → | → | → | → | → | → | → | → | → | → | → | → |
| 9th | The same as Example 2. | | | | → | → | → | → | → | → | → | → | → | → | → | → | → | → |
| 10th | XV | 0.4 | 0.4 | 0.4 | 0.4 | — | — | — | — | — | — | — | — | — | — | — | — | — |
| | XVI | 0.4 | 0.4 | 0.4 | 0.4 | — | — | — | — | — | — | — | — | — | — | — | — | — |
| | XVII | — | — | — | — | 0.8 | 0.8 | 0.8 | 0.8 | 0.8 | 0.8 | — | — | — | — | — | — | — |
| | XVIII | — | — | — | — | — | — | — | — | — | — | 0.4 | 0.4 | 0.4 | — | — | — | — |
| | XIX | — | — | — | — | — | — | — | — | — | — | 0.4 | 0.4 | 0.4 | — | — | — | — |
| | XX | — | — | — | — | — | — | — | — | — | — | — | — | — | 0.4 | 0.4 | 0.4 | — |
| | XXI | — | — | — | — | — | — | — | — | — | — | — | — | — | 0.4 | 0.4 | 0.4 | — |
| | XXII | — | — | — | — | — | — | — | — | — | — | — | — | — | — | — | — | 0.4 |
| | XXIII | — | — | — | — | — | — | — | — | — | — | — | — | — | — | — | — | 0.4 |
| | C-15 | 0.2 | 0.2 | 0.2 | 0.2 | 0.2 | 0.2 | 0.2 | 0.2 | 0.2 | 0.2 | 0.2 | 0.2 | 0.2 | 0.2 | 0.2 | 0.2 | 0.2 |
| | C-13 | — | — | — | — | — | — | — | 0.06 | 0.06 | 0.06 | — | — | — | — | — | — | — |
| | C-17 | — | 0.06 | — | — | — | — | — | — | — | — | — | — | — | — | — | — | — |
| | C-4 | 0.06 | — | 0.06 | 0.06 | 0.06 | 0.06 | 0.06 | — | — | — | — | — | — | — | — | — | — |
| | Others* | The same as in Example 2. | | | | → | → | → | → | → | → | → | → | → | → | → | → | → |
| 11th | XXIV | 0.5 | 0.5 | 0.5 | 0.5 | 0.5 | 0.5 | 0.5 | 0.5 | 0.5 | 0.5 | 0.5 | 0.5 | 0.5 | 0.5 | 0.5 | — | — |
| | XXV | — | — | — | — | — | — | — | — | — | — | — | — | — | — | — | 0.5 | — |
| | XXVI | — | — | — | — | — | — | — | — | — | — | — | — | — | — | — | — | 0.5 |
| | Others* | The same as in Example 2. | | | | → | → | → | → | → | → | → | → | → | → | → | → | → |
| 12th | The same as Example 2. | | | | → | → | → | → | → | → | → | → | → | → | → | → | → | → |
| 13th | S-1 | 1.0 | 1.0 | 1.0 | 1.0 | 1.0 | 1.0 | 1.0 | 1.0 | 1.0 | 1.0 | 0.6 | 0.4 | 0 | 1.0 | 1.0 | 1.0 | 0.4 |
| | Others* | The same as in Example 2. | | | | → | → | → | → | → | → | → | → | → | → | → | → | → |
| Test Results: | | | | | | | | | | | | | | | | | | |
| Test I | | 98 | 93 | 92 | 85 | 88 | 79 | 71 | 60 | 55 | 49 | 98 | 98 | 98 | 97 | 100 | 99 | 98 |
| Test II | | 88 | 84 | 83 | 77 | 79 | 71 | 64 | 54 | 49 | 44 | 69 | 50 | 10 | 93 | 95 | 78 | 98 |

Note:
*"Others" indicated components other than emulsions and couplers.

Coupler C-17:

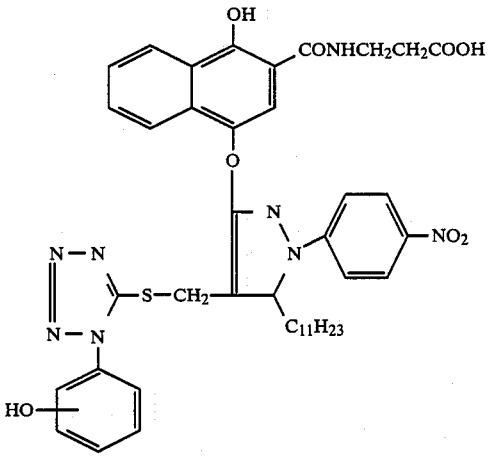

Coupler C-18:

-continued

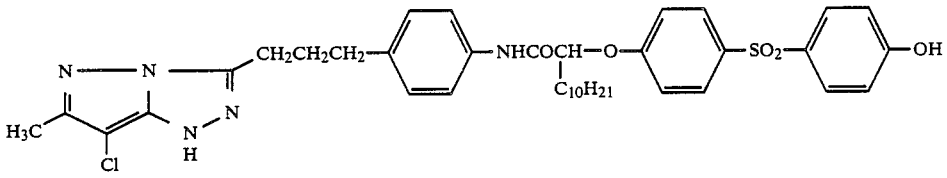

EXAMPLE 6

A polyester film support having a subbing layer was coated with 1st to 15th layers having the compositions shown in Table 4 below in the order listed to prepare Samples 24 and 25 and Comparative Sample 24' and 25'. In Table 4, the units for amounts are g-Ag/m$^2$ for silver halide emulsions, mol/mol-Ag for sensitizing dyes, and g/m$^2$ for other components.

TABLE 4

| Layer | Component | Sample 24 | Sample 25 | Comparative Samples 24'and 25' |
|---|---|---|---|---|
| 1st (AHL) | Black colloidal silver | 0.3 | 0.3 | 0.3 |
| | Gelatin | 1.0 | 1.0 | 1.0 |
| | UV - 101 | 0.1 | 0.1 | 0.1 |
| | UV - 102 | 0.1 | 0.1 | 0.1 |
| | UV - 103 | 0.1 | 0.1 | 0.1 |
| | UV - 104 | 0.1 | 0.1 | 0.1 |
| | Oil - 101 | 0.2 | 0.2 | 0.2 |
| | Oil - 102 | 0.1 | 0.1 | 0.1 |
| 2nd (ML) | Gelatin | 0.1 | 0.1 | 0.1 |
| | C - 101 | 0.02 | 0.02 | 0.02 |
| | Oil - 101 | 0.01 | 0.01 | 0.01 |
| 3rd (RL-U) | Monodisperse silver iodobromide emulsion (silver iodide: 5 mol %; $\bar{\gamma}$: 0.5 μm) | | Polydisperse silver iodobromide emulsion (silver iodide: 5 mol % $\bar{\gamma}$: 0.4 μm) | |
| | | 0.8 | 0.8 | 0.8 |
| | Gelatin | 0.5 | 0.5 | 0.5 |
| | Sensitizing Dye 100-I | $3 \times 10^{-4}$ | $3 \times 10^{-4}$ | $3 \times 10^{-4}$ |
| | Sensitizing Dye 100-II | $2 \times 10^{-4}$ | $2 \times 10^{-4}$ | $2 \times 10^{-4}$ |
| | C - 101 | 0.3 | 0.3 | 0.3 |
| | C - 102 | 0.05 | 0.05 | 0.05 |
| | C - 103 | 0.03 | 0.03 | — |
| | C - 104 | 0.01 | 0.01 | — |
| | C - 112 | — | — | 0.05 |
| | Oil - 103 | 0.03 | 0.03 | 0.03 |
| | Oil - 104 | 0.03 | 0.03 | 0.03 |
| 4th (ML) | Gelatin | 1.0 | 1.0 | 1.0 |
| | Compound 100 - A | 0.1 | 0.1 | 0.1 |
| | C - 104 | — | 0.02 | — |
| 5th (Gl-U) | Monodisperse silver iodobromide emulsion (silver iodide: 2 mol %; $\bar{\gamma}$: 0.8 μm) | | Polydisperse silver iodobromide emulsion (silver iodide: 2 mol % $\bar{\gamma}$: 0.7 μm) | |
| | | 0.9 | 0.9 | 0.9 |
| | Gelatin | 0.8 | 0.8 | 0.8 |
| | Sensitizing Dye 100-IV | $3 \times 10^{-4}$ | $3 \times 10^{-4}$ | $3 \times 10^{-4}$ |
| | Sensitizing Dye 100-IV | $1 \times 10^{-4}$ | $1 \times 10^{-4}$ | $1 \times 10^{-4}$ |
| | Sensitizing Dye 100-V | $1 \times 10^{-4}$ | $1 \times 10^{-4}$ | $1 \times 10^{-4}$ |
| | C - 105 | 0.7 | 0.7 | 0.7 |
| | C - 106 | 0.1 | 0.1 | 0.1 |
| | C - 107 | 0.1 | 0.1 | 0.1 |
| | C - 108 | 0.05 | — | — |
| | C - 109 | 0.02 | 0.02 | — |
| | C - 104 | — | 0.05 | — |
| | Oil - 103 | 0.1 | 0.1 | 0.1 |
| 6th (ML) | Fine silver bromide ($\bar{\gamma}$: 0.07 μm) | 0.15 | 0.15 | 0.15 |
| | Gelatin | 1.0 | 1.0 | 1.0 |
| 7th (BL-U) | Monodisperse silver iodobromide emulsion (silver iodide: 8 mol %; $\bar{\gamma}$: 0.7 μm) | | Polydisperse silver iodobromide emulsion (silver iodide: 8 mol %; $\bar{\gamma}$: 0.55 μm) | |
| | | 0.4 | 0.4 | 0.4 |
| | Gelatin | 1.0 | 1.0 | 1.0 |
| | Sensitizing Dye 100-VI | $2 \times 10^{-4}$ | $2 \times 10^{-4}$ | $2 \times 10^{-4}$ |
| | Sensitizing Dye 100-VII | $2 \times 10^{-4}$ | $2 \times 10^{-4}$ | $2 \times 10^{-4}$ |
| | C - 110 | 1.2 | 1.2 | 1.2 |
| | C - 111 | 0.2 | — | — |
| | C - 114 | — | 0.05 | — |
| | Oil - 101 | 0.1 | 0.1 | 0.1 |
| 8th (ML) | Gelatin | 0.05 | 0.05 | 0.05 |
| | Compound 100-B | 0.1 | 0.1 | 0.1 |

TABLE 4-continued

| Layer | Component | Sample 24 | Sample 25 | Comparative Samples 24'and 25' |
|---|---|---|---|---|
| | Oil - 105 | 0.05 | 0.05 | 0.05 |
| 9th (RL-O) | Silver iodobromide emulsion (Silver iodide: 12 mol %; $\bar{\gamma}$: 1.5 μm) | 1.5 | 1.5 | 1.5 |
| | Gelatin | 1.2 | 1.2 | 1.2 |
| | Sensitizing Dye 100-I | $3 \times 10^{-4}$ | $3 \times 10^{-4}$ | $3 \times 10^{-4}$ |
| | Sensitizing Dye 100-II | $3 \times 10^{-4}$ | $3 \times 10^{-4}$ | $3 \times 10^{-4}$ |
| | C - 112 | 0.1 | 0.1 | 0.102 |
| | C - 101 | 0.3 | 0.3 | 0.3 |
| | C - 103 | 0.02 | 0.02 | — |
| | Oil - 104 | 0.2 | 0.2 | 0.2 |
| 10th (ML) | Gelatin | 1.0 | 1.0 | 1.0 |
| | C - 107 | 0.2 | 0.2 | 0.2 |
| | Compound 100-A | 0.1 | 0.1 | 0.1 |
| | Oil - 103 | 0.05 | 0.05 | 0.05 |
| 11th (GL-O) | Tabular silver iodobromide emulsion (silver iodide: 10 mol %; $\bar{\gamma}$: 2 μm; mean aspect ratio: 10) | | Polydisperse silver iodobromide emulsion (silver iodide: 10 mol % $\bar{\gamma}$: 1.7 μm) | |
| | | 1.5 | 1.5 | 1.5 |
| | Gelatin | 1.0 | 1.0 | 1.0 |
| | C - 113 | 0.2 | 0.2 | 0.2 |
| | C - 108 | 0.02 | 0.02 | — |
| | Oil - 101 | 0.4 | 0.4 | 0.4 |
| 12th (YFL) | Gelatin | 1.2 | 1.2 | 1.2 |
| | Yellow colloidal silver | 0.2 | 0.2 | 0.2 |
| | Compound 100-B | 0.2 | 0.2 | 0.2 |
| | Oil - 101 | 0.2 | 0.2 | 0.2 |
| 13th (BL-O) | Tabular silver iodobromide emulsion (silver iodide: 3 mol %; $\bar{\gamma}$: 2.5 μm; mean aspect ratio: 15) | | Polydisperse silver iodobromide emulsion (silver iodide: 3 mol %; $\bar{\gamma}$: 2.0 μ) | |
| | | 0.8 | 0.8 | 0.8 |
| | Fine silver iodobromide emulsion ($\bar{\gamma}$: 0.09 μm) | 0.2 | 0.2 | 0.2 |
| | Gelatin | 1.2 | 1.2 | 1.2 |
| | Sensitizing Dye 100-VI | $3 \times 10^{-4}$ | $3 \times 10^{-4}$ | $3 \times 10^{-4}$ |
| | Sensitizing Dye 100-VII | $1 \times 10^{-4}$ | $1 \times 10^{-4}$ | $1 \times 10^{-4}$ |
| | C - 110 | 0.3 | 0.3 | 0.3 |
| | C - 111 | 0.3 | — | — |
| | C - 114 | — | 0.02 | — |
| | Oil - 101 | 0.06 | 0.06 | 0.06 |
| 14th (PC-1) | Fine silver bromide emulsion ($\bar{\gamma}$: 0.07 μm) | 0.2 | 0.2 | 0.2 |
| | UV - 101 | 0.05 | 0.05 | 0.05 |
| | UV - 102 | 0.05 | 0.05 | 0.05 |
| | UV - 103 | 0.05 | 0.05 | 0.05 |
| | UV - 104 | 0.05 | 0.05 | 0.05 |
| | UV - 105 | 0.02 | 0.02 | 0.02 |
| | Gelatin | 0.6 | 0.6 | 0.6 |
| | Oil - 104 | 0.1 | 0.1 | 0.1 |
| 15th (PC-2) | Gelatin | 0.5 | 0.5 | 0.5 |
| | Polymethyl methacrylate particles ($\bar{\gamma}$: 1.5 μm) | 0.2 | 0.2 | 0.2 |

The compounds used in the sample preparation are shown below.

C-101

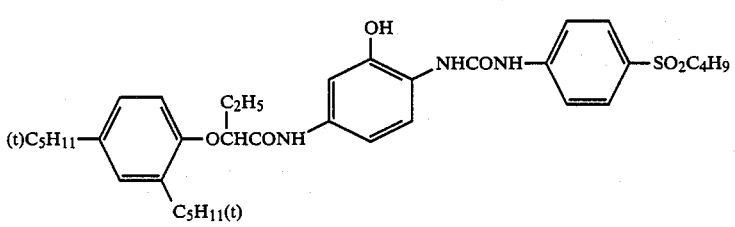

-continued
C-102
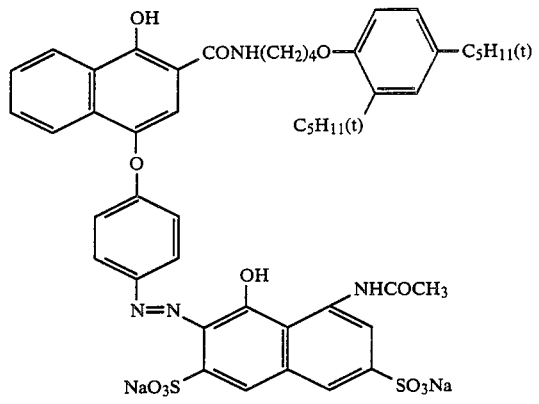
C-103
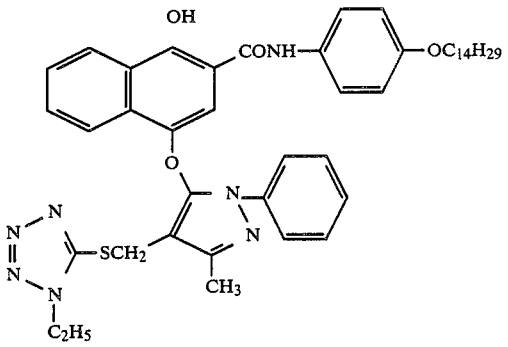
C-104
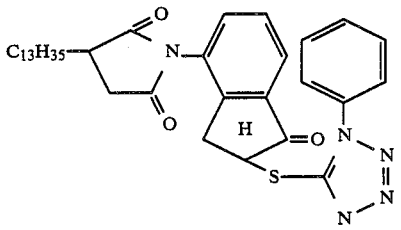
C-105
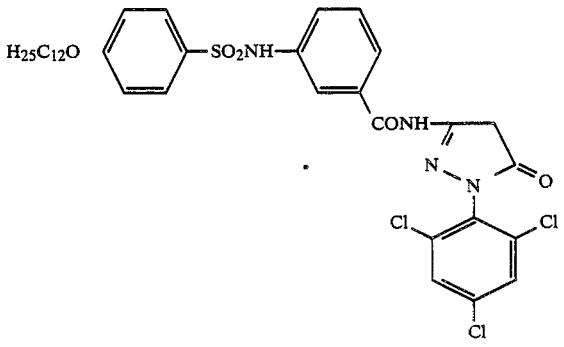

-continued
C-106
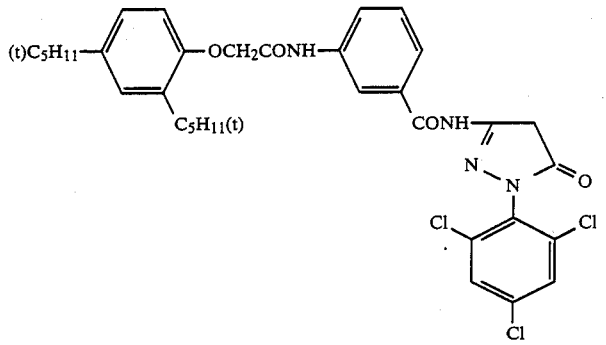
C-107
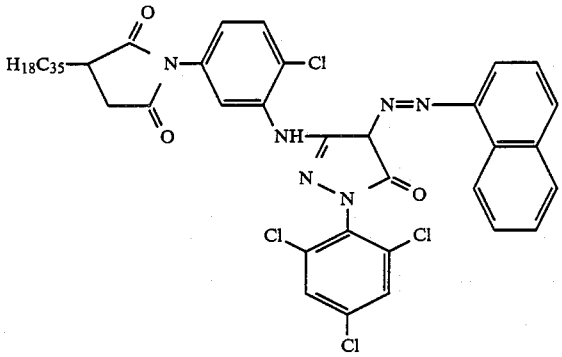
C-108
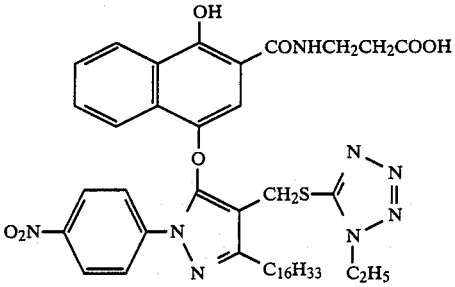
C-109
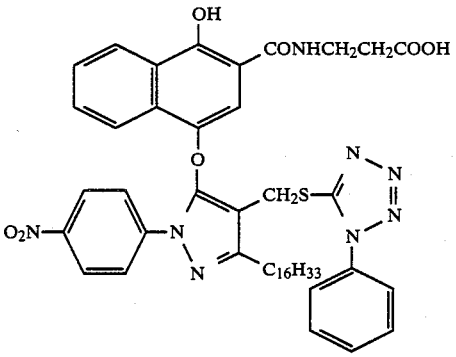
C-110
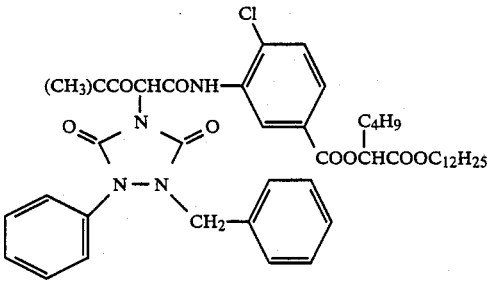

-continued
C-111
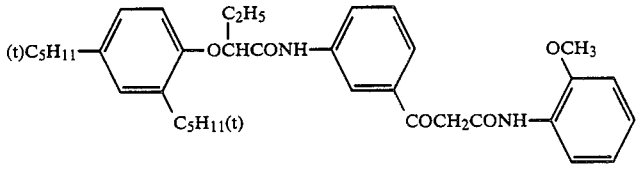
C-112
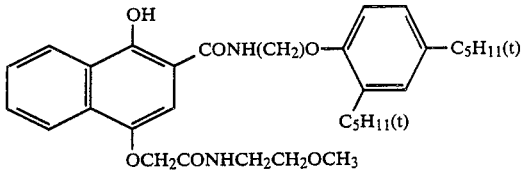
C-113
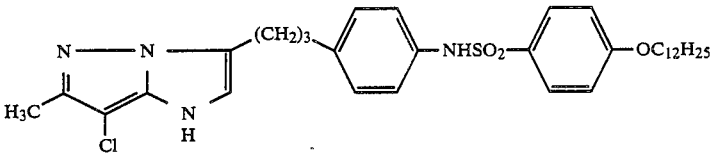
C-114
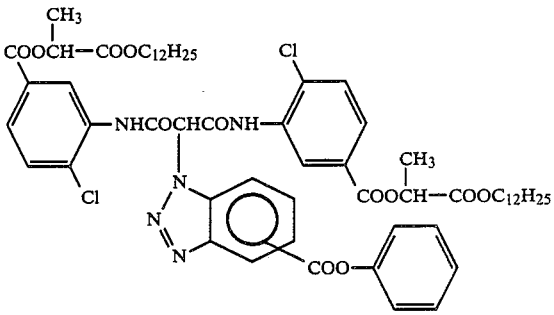
Sensitizing Dye
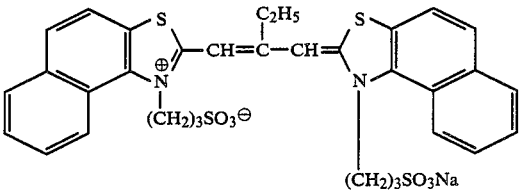
Sensitizing Dye 100-II
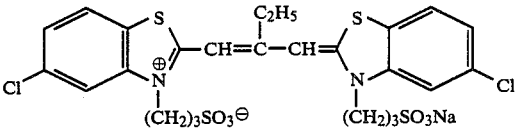
Sensitizing Dye 100-III
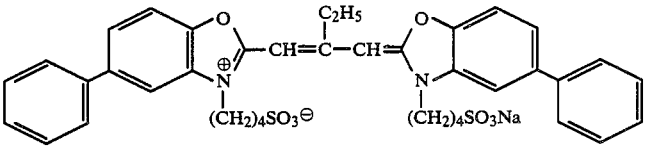
Sensitizing Dye 100-IV
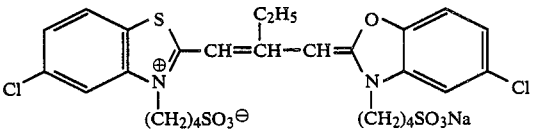

-continued
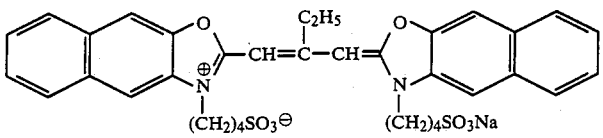
Sensitizing Dye 100-V
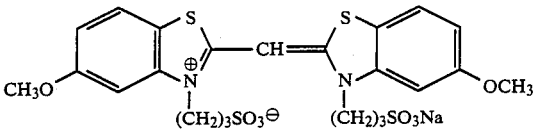
Sensitizing Dye 100-VI
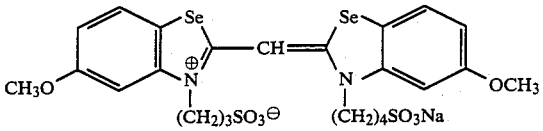
Sensitizing Dye 100-VII
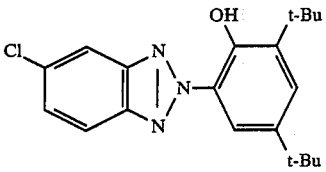
UV-101
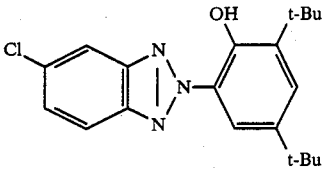
UV-102
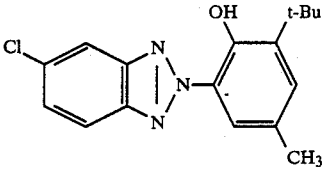
UV-103
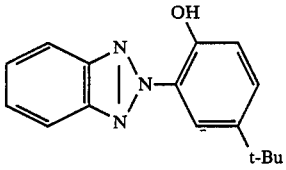
UV-104
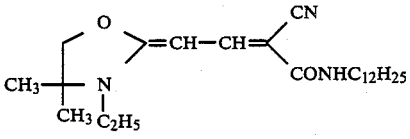
UV-105
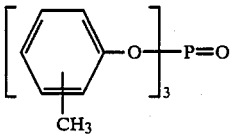
Oil-101
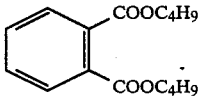
Oil-102

-continued

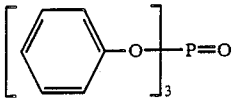

Oil-103

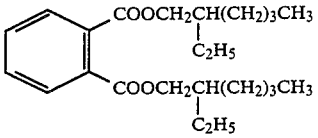

Oil-104

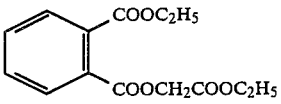

Oil-105

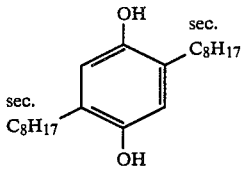

Compound 100-A

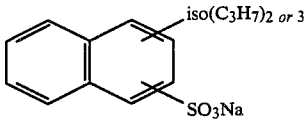

W-101

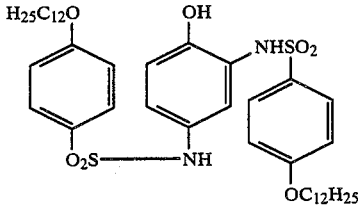

Compound 100-B

Each of Samples 24, 25, 24′ and 25′ was sensitometrically exposed to light through a filter using a tungsten lamp (color temperature: 4800°K), and the exposed sample was developed in the same manner as in Example 1. As a result, the ISO sensitivity of Samples 24 and 25 was both about 400, and that of Comparative Samples 24′ and 25′ was about 450, but the color balance of Comparative Sample was poor. Sample 25′ having the similar structure as Sample 24′ had an ISO sensitivity of about 100.

Figure 2:
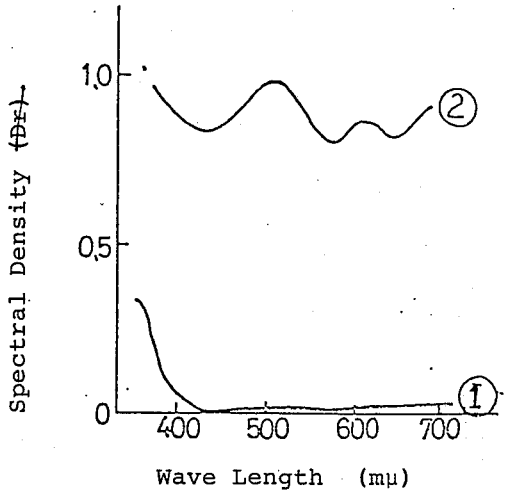
FIG. 2 is a graph showing spectral absorption characteristics of the photochromic filter used in Eample 6.

A photochromic filter was fixed to a case of a package unit in front of an opening for light exposure (in front of a lens). The photochromic filter was prepared by attaching a polystyrene film containing 1,3,3-trimethylindoline-6′-methoxy-8′-nitrospirobenzopyran onto a photochromic glass filter containing silver iodide. The absorption spectrum of the photochromic filter is shown in FIG. 2. In the Figure, Curve (1) is a spectrum under an indoor light, and Curve (2) is a spectrum under sunlight.

Each of the samples was loaded in a package unit with or without the photochromic filter to prepared 8 package units. A photograph of a person having colors was taken with each of the package units under outdoor sunlight (Condition I) or under an indoor light emitted from a fluorescent lamp combined with the light from a window (about 300 lux) (Condition II). The exposed film was developed and printed on an enlarging print in the same manner as in Example 2. The resulting print was evaluated for hue and sharpness (according to the criterion described in Example 2). The results obtained are shown in Table 5.

TABLE 5

| Photo-graphing Condition | Photo-chromic Filter | Sample No. | Hue | Sharpness | Synthetic Evaluation |
|---|---|---|---|---|---|
| I | not used | 24 | Acceptable | Acceptable | Acceptable |
| I | " | 25 | Good | Good | Good |
| I | " | 24′ | Unacceptable | Unacceptable | Unacceptable |
| I | " | 25′ | Acceptable | Acceptable | Acceptable |
| I | Used | 24 | Excellent | Good | Good |
| I | " | 25 | Excellent | Excellent | Excellent |
| I | " | 24′ | Acceptable | Unacceptable | Unacceptable |
| I | " | 25′ | Unacceptable | Unacceptable | Unacceptable |
| II | Not used | 24 | Good | Good | Good |
| II | " | 25 | Good | Excellent | Good |

TABLE 5-continued

| Photo-graphing Condition | Photo-chromic Filter | Sample No. | Hue | Sharpness | Synthetic Evaluation |
|---|---|---|---|---|---|
| II | " | 24' | Acceptable | Acceptable | Acceptable |
| II | " | 25' | Unacceptable | Unacceptable | Unacceptable |
| II | Used | 24 | Good | Good | Good |
| II | " | 25 | Good | Excellent | Good |
| II | " | 24' | Acceptable | Unacceptable | Unacceptable |
| II | " | 25' | Acceptable | Acceptable | Acceptable |

It can be seen from Table 5 that the light-sensitive material package units in accordance with the present invention are excellent in exposure latitude and image sharpness.

As described above, color images of high quality can be obtained by using the light-sensitive materials having improved exposure latitude and improved sharpness according to the present invention even when applied for use in package units having an exposure function of a fixed focus system and a limited shutter speed. Further, when a photochromic function is added to the exposure function, the latitude can further be improved for either outdoor photographing or indoor photographing.

While the invention has been described in detail and with reference to specific embodiments thereof, it will be apparent to one skilled in the art that various changes and modifications can be made therein without departing from the spirit and scope thereof.

What is claimed is:

1. A light sensitive material package unit having an exposure function comprising a case having therein a light-sensitive material, said case having an exposure function comprising a fixed focus lens and a shutter and an outer package, in which said light-sensitive material is protected from the outer atmosphere by said case and said outer package, and said light-sensitive material comprises a support having provided thereon at least one red-sensitive silver halide emulsion layer containing at least one cyan coupler, at least one green-sensitive silver halide emulsion layer containing a magenta coupler, and at least one blue-sensitive silver halide emulsion layer containing a yellow coupler; at least one of said light-sensitive emulsion layers is composed of at least two layers being substantially the same in color sensitivity and different in sensitivity; and said light-sensitive emulsion layer composed of at least two layers contains a compound represented by formula (I)

$$A-(L_1)_b-Z_1 \quad (I)$$

wherein A represents a component capable of releasing $-(L_1)_b-Z_1$ upon reacting with an oxidation product of a color developing agent; $L_1$ represents a timing group; $Z_1$ represents a residual group having active development inhibitory property; and b represents 0 or 1.

2. A light-sensitive material package unit as in claim 1, wherein said light-sensitive material contains at least one compound represented by formula (I) wherein b is 0 and at least one compound represented by formula (I) wherein b is 1.

3. A light-sensitive material package unit as in claim 1, wherein said compound represented by formula (I) is present in the layer having a higher sensitivity of said two layers being substantially the same in color sensitivity and different in sensitivity.

4. A light-sensitive material package unit as in claim 3, wherein said light-sensitive emulsion layer having a higher sensitivity contains at least one compound represented by formula (I) wherein b is 0 and at least one compound represented by formula (I) wherein b is 1.

5. A light-sensitive material package unit as in claim 1, wherein the light-sensitive emulsion layer containing said compound represented by formula (I) comprises a monodisperse silver halide emulsion.

6. A light-sensitive material package unit as in claim 1, wherein said light-sensitive emulsion layer containing said compound represented by formula (I) comprises an emulsion containing tubular silver halide grains having an aspect ratio of about 5 or more.

7. A light-sensitive material package unit as in claim 1, wherein said compound represented by formula (I) is a compound wherein A is a cyan coupler residual group and is present in said blue-sensitive emulsion layer or green-sensitive emulsion layer.

8. A light-sensitive material package unit as in claim 1, wherein said compound represented by formula (I) is a compound wherein A is a yellow coupler residual group or a colorless coupler residual group, and is present in said red-sensitive emulsion layer or green-sensitive emulsion layer.

9. A light-sensitive material package unit as in claim 1, wherein said light-sensitive material further contains at least 50 $mg/m^2$ of a formalin scavenger.

10. A light-sensitive material package unit as in claim 1, wherein said exposure function includes a photochromic function.

11. A light-sensitive material package unit as in claim 3, wherein said light-sensitive emulsion layer contain a non-timing DIR coupler and a timing DIR coupler.

12. A light-sensitive material package unit as in claim 10, wherein said photochromic function is a photochromic glass filter having a transmittance of about 100% indoors and about 10% outdoors.

13. A light-sensitive material package unit as in claim 1, wherein said component represented by formula (I) is a compound represented by formula (II):

$$A-[(L_1)_b-z-(L_2-Y)_c]_p \quad (II)$$

wherein A represents a component capable of releasing $-(L_1)_b-Z-(L_2-Y)_c$ or $-Z-(L_2-Y)_c$ upon reacting with an oxidation product of a color developing agent; $L_1$ represents a timing group; b represents 0 or 1. Z represents a basic structure of a development inhibitor bonded to the coupling position of the coupler residue A either directly (when b=0) or via a linking group $L_1$ (when b=1); Y represents a substituent bonded to Z via a linking group $L_2$, which functions to manifestate the development inhibitory activity of Z; $L_2$ represents a linking group containing a chemical bond capable of being cut off in a developer; c represents 1 or 2; when c is 2, $-L_2-Y$ may be the same or different; and p represents 1 or 2.

* * * * *